US011819912B2

(12) United States Patent
Moon et al.

(10) Patent No.: US 11,819,912 B2
(45) Date of Patent: Nov. 21, 2023

(54) HIGH-QUALITY SEMI-SOLID SLURRY MANUFACTURING APPARATUS AND METHOD USING OPTIMIZED PROCESS PARAMETERS, AND COMPONENT MOLDING APPARATUS INCLUDING SEMI-SOLID SLURRY MANUFACTURING APPARATUS

(71) Applicant: SEMYUNGTECH, Seoul (KR)

(72) Inventors: Seongwon Moon, Seongnam-si (KR); Junyoung Lee, Asan-si (KR); Seungyong Lee, Asan-si (KR)

(73) Assignee: SEMYUNGTECH, Seoul (KR)

( * ) Notice: Subject to any disclaimer, the term of this patent is extended or adjusted under 35 U.S.C. 154(b) by 161 days.

(21) Appl. No.: 17/440,176

(22) PCT Filed: Feb. 27, 2020

(86) PCT No.: PCT/KR2020/002828
§ 371 (c)(1),
(2) Date: Sep. 16, 2021

(87) PCT Pub. No.: WO2020/189913
PCT Pub. Date: Sep. 24, 2020

(65) Prior Publication Data

US 2022/0161317 A1 May 26, 2022

(30) Foreign Application Priority Data

Mar. 19, 2019 (KR) ..... 10-2019-0031414
Mar. 21, 2019 (KR) ..... 10-2019-0032435
(Continued)

(51) Int. Cl.
*B22D 17/00* (2006.01)
*B22D 41/01* (2006.01)
*B22D 41/00* (2006.01)

(52) U.S. Cl.
CPC ..... *B22D 41/01* (2013.01); *B22D 17/007* (2013.01); *B22D 41/001* (2013.01)

(58) Field of Classification Search
CPC ..... B22D 17/007; B01F 33/45
See application file for complete search history.

(56) References Cited

FOREIGN PATENT DOCUMENTS

JP 2008000777 A * 1/2008
JP 2011-104600 A 6/2011
(Continued)

OTHER PUBLICATIONS

EPO machine translation of JP 2011-104600 A (Year: 2011).*
EPO translation of KR 10-2004-0027266 A (Year: 2004).*

*Primary Examiner* — Kevin E Yoon
(74) *Attorney, Agent, or Firm* — Bridgeway IP Law Group, PLLC; Sang Ho Lee; Hyun Woo Shin

(57) ABSTRACT

Provided is a high-quality semi-solid slurry manufacturing apparatus and method using optimized process parameters, and a component molding apparatus including the semi-solid slurry manufacturing apparatus, and particularly, a high-quality semi-solid slurry manufacturing apparatus and method using optimized process parameters, which can optimize process parameters for manufacturing a semi-solid slurry such that a fine slurry structure and uniform spheroidized particles are obtained and can obtain high-quality products by increasing convenience and productivity of the apparatus, and a component molding apparatus including the semi-solid slurry manufacturing apparatus.

6 Claims, 27 Drawing Sheets

FIG. 7

(30) Foreign Application Priority Data

| | | |
|---|---|---|
| Mar. 21, 2019 | (KR) | 10-2019-0032437 |
| May 8, 2019 | (KR) | 10-2019-0053501 |
| May 8, 2019 | (KR) | 10-2019-0053510 |
| May 8, 2019 | (KR) | 10-2019-0053525 |

(56) References Cited

FOREIGN PATENT DOCUMENTS

| | | | | |
|---|---|---|---|---|
| KR | 10-2004-0027266 | A | | 4/2004 |
| KR | 10-0445643 | B1 | | 8/2004 |
| KR | 10-0554093 | B1 | | 2/2006 |
| KR | 10-0869525 | B1 | | 11/2008 |
| KR | 10-2009-0099375 | A | | 9/2009 |
| KR | 1020100032031 | A | * | 3/2010 |
| KR | 10-1062247 | B1 | | 9/2011 |
| KR | 10-1190176 | B1 | | 10/2012 |
| KR | 10-1251275 | B1 | | 4/2013 |
| KR | 10-1811860 | B1 | | 12/2017 |
| KR | 10-2018-0108775 | A | | 10/2018 |
| KR | 10-2042715 | B1 | | 11/2019 |
| KR | 10-2042720 | B1 | | 11/2019 |
| KR | 10-2042733 | B1 | | 11/2019 |

* cited by examiner

HIGH-QUALITY SEMI-SOLID SLURRY MANUFACTURING APPARATUS AND METHOD USING OPTIMIZED PROCESS PARAMETERS, AND COMPONENT MOLDING APPARATUS INCLUDING SEMI-SOLID SLURRY MANUFACTURING APPARATUS

TECHNICAL FIELD

The present invention relates to high-quality semi-solid slurry manufacturing apparatus and method using optimized process parameters, and to a component molding apparatus including the semi-solid slurry manufacturing apparatus, and particularly, to high-quality semi-solid slurry manufacturing apparatus and method using optimized process parameters, which can optimize process parameters for manufacturing a semi-solid slurry such that a fine slurry structure and uniform spheroidized particles are obtained and can obtain high-quality products by increasing convenience and productivity of the apparatus, and to a component molding apparatus including the semi-solid slurry manufacturing apparatus.

BACKGROUND

A solid-liquid coexistence metal material, that is, a semi-solid slurry, refers to an intermediate product of a complex processing method commonly known as rheocasting and thixocasting, and refers to a metal material that can be deformed even by a small force due to a thixotropic property in a state where liquid and spherical crystal grains are mixed in an appropriate ratio at a temperature of a semi-solid zone, has excellent fluidity, and can be easily formed like a liquid phase.

Here, the rheocasting refers to a processing method of manufacturing a billet or a final molded product by casting or forging a metal slurry with a predetermined viscosity due to non-solidification, and the thixocasting refers to a processing method in which a billet manufactured by the rheocasting is reheated to a metal slurry in a semi-molten state and then the slurry is molded or forged to produce a final product.

This rheocasting/thixocasting have several advantages compared to general molding methods using a metal material, such as casting or molten metal forging. For example, since a slurry used in the rheocasting/thixocasting has fluidity at a lower temperature than a metallic material, a temperature of a die exposed to the slurry can be lower than a temperature of the metallic material, and thus a lifespan of the die is increased. In addition, when the slurry is extruded along a cylinder, the occurrence of turbulence is reduced, resulting in reduction of mixing of air during a casting process, and thus, the occurrence of pores in the final product can be reduced. In addition, solidification shrinkage can be reduced, workability can be improved, mechanical properties and corrosion resistance of the product can be improved, and the product weight can be reduced. Accordingly, the slurry can be utilized as a new material for electric and electronic information and communication equipment in automobile and aircraft industries.

Meanwhile, the rheocasting of the related art makes spherical particles suitable for solid-state molding by destroying the previously formed dendrite crystal structure by stirring a metal material mainly at a temperature below a liquidus when cooling the metal material, and the stirring method may be mechanical stirring, electromagnetic stirring, gas bubbling, low frequency, high frequency or electromagnetic wave vibration, or agitation by electric shock.

Here, according to the mechanical stirring method, high shear force can be generated with a simple principle, and a spherical structure can be easily obtained, but there are limitations in terms of wear of the stirring unit, interference of impurities, deterioration of quality, difficulty in process control, economic feasibility, and so on, and fluidity of the slurry is low due to the limited space formed between the stirring unit and the stirring vessel, resulting in high cost of continuous casting.

Meanwhile, according to the electromagnetic stirring method, the heat extraction rate and the shearing action can be precisely adjusted, billets can be manufactured at a competitive rate, and particularly, intervention of gases, impurities, oxides, and so on can be reduced to obtain a high-quality spheroidized structure. Thus, the electromagnetic stirring method is used as the most effective stirring in modern major industries that require high quality materials such as defense, aerospace, and special security components for automobiles.

However, even using the electromagnetic stirring method, quality of the semi-solid slurry is significantly affected by various parameters for slurry manufacturing such as the temperature of the molten metal, the temperature of the slurry cup containing the molten metal, the shape of the slurry cup, and the stirring time. Thus, in order to achieve a high quality, parameters that optimize the structure of a semi-solid slurry has to be identified, and establishment of a suitable process is required.

In addition, the high quality of the semi-solid slurry processed through the rheocasting/thixocasting can be achieved under conditions such as minimizing an inflow of a foreign substance into the interior in addition to optimizing parameters through a balanced thermal gradient. In addition, it is also important to secure productivity that can produce the semi-solid slurry more quickly with the same quality.

Accordingly, there is a need for semi-solid slurry manufacturing apparatus and method capable of securing productivity while achieving a high-quality semi-solid slurry in accordance with an increase in use of new materials for electric and electronic information and communication equipment in the automobile and aircraft industries.

SUMMARY OF INVENTION

Technical Problem

An object of an embodiment of the present invention is to provide high-quality semi-solid slurry manufacturing apparatus and method using optimized process parameters, which minimize an inflow of a foreign substance while minimizing a change in a temperature between a slurry cup, which is a space where a slurry is manufactured, and a molten metal flowing into the slurry cup and simplifying processes, and increase quality of a semi-solid slurry by providing optimized process parameters so as to obtain spheroidized particles having fine and uniform a slurry structure, and improve convenience and productivity, and a component molding apparatus including the semi-solid slurry manufacturing apparatus.

Solution to Problem

A high-quality semi-solid slurry manufacturing apparatus using optimized process parameters and using a slurry cup, according to an embodiment of the present invention, includes a high-pressure washing unit configured to simultaneously remove and cool a foreign substance in the slurry cup by using high-pressure air blow; a release agent coating unit configured to apply a release agent to an inside of the slurry cup in which the foreign substance is removed and cooled by the high-pressure washing unit; a preheating unit configured to preheat the slurry cup to which the release agent is applied by the release agent coating unit; an injection unit configured to inject a molten metal into the slurry cup preheated by the preheating unit; and an electronic stirring unit configured to electronically stir the slurry cup into which the molten metal is injected by the injection unit.

Here, the semi-solid slurry manufacturing apparatus may further include slurry cup fixing means capable of holding or inserting the slurry cup, and a plunger provided at a lower portion of the slurry cup fixing means and connected to a drive unit by a piston rod to move up and down the slurry cup held by or inserted into the slurry cup fixing means, wherein the slurry cup fixing means and the plunger can be provided in at least one of the high-pressure washing unit, the release agent coating unit, the preheating unit, the injection unit, and the electronic stirring unit.

In addition, the semi-solid slurry manufacturing apparatus may further include an angle rotation adjustment portion provided at the lower portion of the slurry cup fixing means to rotate the slurry cup after an angle of the slurry cup is adjusted.

In addition, the angle rotation adjustment portion may include two rotation plate bodies that include a plurality of movement grooves and are symmetrical up and down and are connected to each other by a connection unit, and an angle adjustment ball which is provided in a center between the two rotation plate bodies and moves along one of the plurality of movement grooves by a magnetic field applied by a magnetic field control unit, wherein the connection unit may be formed fluidly to vary a height freely.

In addition, the angle rotation adjustment portion may include a donut-shaped guide plate body that includes one side having a low inclination portion and the other side having a high inclination portion, and a rotation body provided at a center of the guide plate body to rotate the slurry cup.

In addition, the semi-solid slurry manufacturing apparatus may further include a slurry cup thickness determining unit configured to determine a thickness of the slurry cup before the foreign substance in the slurry cup is removed and cooled, wherein the slurry cup thickness determining unit may determine the thickness of the slurry cup by layering a plurality of thin slurry cup faceted bodies.

In addition, the electronic stirring unit may set or adjust process parameters including a voltage, a current, and a stirring time by using a control unit that performs an automatic control according to the set parameters.

Meanwhile, a component molding system including a high-quality semi-solid slurry manufacturing apparatus using optimized process parameters, according to an embodiment of the present invention, includes the semi-solid slurry manufacturing apparatus; a separation unit configured to separate a semi-solid slurry manufactured by transferring the slurry cup of the semi-solid slurry manufacturing apparatus from the slurry cup; and a molding unit configured to receive the manufactured semi-solid slurry from the separation unit to mold a component.

Meanwhile, a high-quality semi-solid slurry manufacturing method using optimized process parameters, according to an embodiment of the present invention, includes (a) step of ladling a molten metal in a melting furnace; (b) step of injecting the ladled molten metal into a slurry cup; (c) step of electronically stirring the molten metal injected into the slurry cup; and (d) step of separating the stirred molten metal from the slurry cup, wherein the electronic stirring can start before or during the injection of the molten metal to electronically stir the injected molten metal and can be performed for 10 seconds to 30 seconds after the injection of the molten metal is completed.

Here, in the step (b), the molten metal may be injected at temperatures of 610° C. to 650° C.

In addition, in the step (b), the molten metal may be injected while the slurry cup is preheated to temperatures of 60° C. to 120° C.

In addition, a thickness of the slurry cup may be 2 mm to 6 mm.

In addition, the thickness of the slurry cup may be easily adjusted by layering a plurality of faceted bodies having a thickness of 0.5 mm to 1 mm and fixing the plurality of layered faceted bodies.

Advantageous Effects

According to high-quality semi-solid slurry manufacturing apparatus and method using optimized process parameters according to embodiments of the present invention, there are advantages in that quality of a semi-solid slurry is increased by minimizing an inflow of a foreign substance while minimizing a change in a temperature between a slurry cup, which is a space where a slurry is manufactured, and a molten metal injected into the slurry cup, and simplifying processes, and convenience and productivity are improved.

In addition, according to the high-quality semi-solid slurry manufacturing apparatus and method using optimized process parameters according to the embodiments of the present invention, there are advantages in that a fine slurry structure can be obtained and uniform spheroidized particles can be obtained through optimization of various parameters for slurry manufacturing, such as a temperature of a slurry cup, a shape of the slurry cup, and a stirring time, and thus, excellent product quality can be achieved and the apparatus and method can be easily used in fields such as defense and special security components for aerospace and automobiles that require a high quality.

In addition, according to the high-quality semi-solid slurry manufacturing apparatus and method using optimized process parameters according to the embodiments of the present invention, there is an advantage in that manufacturing through electronic stirring can be performed to increase productivity and reduce a manufacturing cost.

BEST MODE

Figure 1:
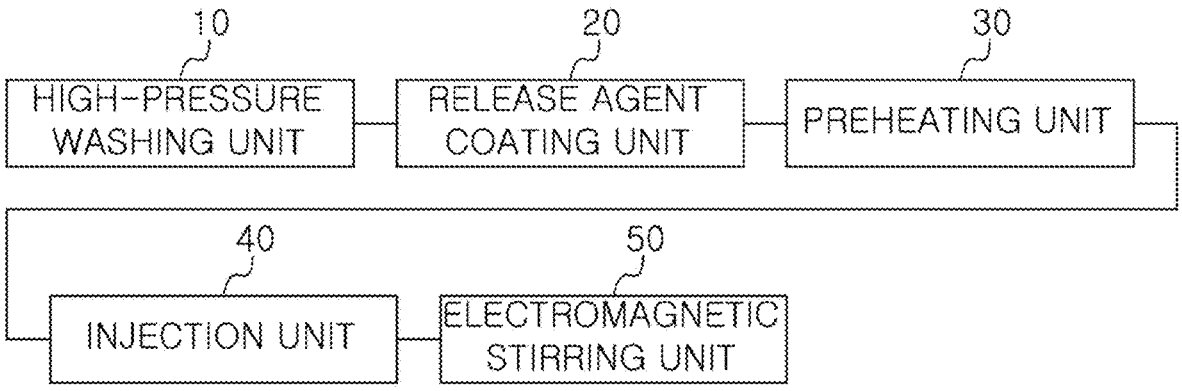
FIG. 1 is a configuration block diagram of a high-quality semi-solid slurry manufacturing apparatus using optimized process parameters according to an embodiment of the present invention.

A high-quality semi-solid slurry manufacturing apparatus using optimized process parameters and using a slurry cup, according to an embodiment of the present invention, can include a high-pressure washing unit configured to simultaneously remove and cool a foreign substance in the slurry cup by using high-pressure air blow; a release agent coating unit configured to apply a release agent to an inside of the slurry cup in which the foreign substance is removed and cooled by the high-pressure washing unit; a preheating unit configured to preheat the slurry cup to which the release agent is applied by the release agent coating unit; an injection unit configured to inject a molten metal into the slurry cup preheated by the preheating unit; and an electronic stirring unit configured to electronically stir the slurry cup into which the molten metal is injected by the injection unit.

A component molding system including a high-quality semi-solid slurry manufacturing apparatus using optimized process parameters, according to an embodiment of the present invention, can include the semi-solid slurry manufacturing apparatus; a separation unit configured to separate a semi-solid slurry manufactured by transferring the slurry cup of the semi-solid slurry manufacturing apparatus from the slurry cup; and a molding unit configured to receive the manufactured semi-solid slurry from the separation unit to mold a component.

A high-quality semi-solid slurry manufacturing method using optimized process parameters, according to an embodiment of the present invention, can include (a) step of ladling a molten metal in a melting furnace; (b) step of injecting the ladled molten metal into a slurry cup; (c) step of electronically stirring the molten metal injected into the slurry cup; and (d) step of separating the stirred molten metal from the slurry cup, wherein the electronic stirring can start before or during the injection of the molten metal to electronically stir the injected molten metal and can be performed for 10 seconds to 30 seconds after the injection of the molten metal is completed.

DETAILED DESCRIPTION OF EMBODIMENTS

Hereinafter, description of the present invention made with reference to the drawings is not limited to specific embodiments, and various modifications can be made, and various embodiments can be provided. In addition, it should be understood that content described below includes all transformations, equivalents, and substitutes included in the idea and scope of the present invention.

In the following description, terms such as first, second, and so on are terms used to describe various configuration elements, meanings thereof are not limited thereto, and are used only for the purpose of distinguishing one configuration element from another configuration element.

Like reference numbers used throughout this specification refer to like components.

As used herein, singular expression includes plural expression unless the context clearly describes otherwise. In addition, it should be construed that terms such as "include", "comprise", and "have" described below are intended to designate existence of features, numbers, steps, operations, configuration elements, components, or combinations thereof described in the specification, and it should be understood that possibility of addition or existence of one or more other features, numbers, steps, operations, configuration elements, components, or combinations thereof is not precluded.

Hereinafter, high-quality semi-solid slurry manufacturing apparatus and method using optimized process parameters according to a preferred embodiment of the present invention will be described in detail with reference to FIGS. 1 to 30.

First, a high-quality semi-solid slurry manufacturing apparatus using optimized process parameters according to the embodiment of the present invention will be described with reference to FIGS. 1 to 11.

Figure 2:
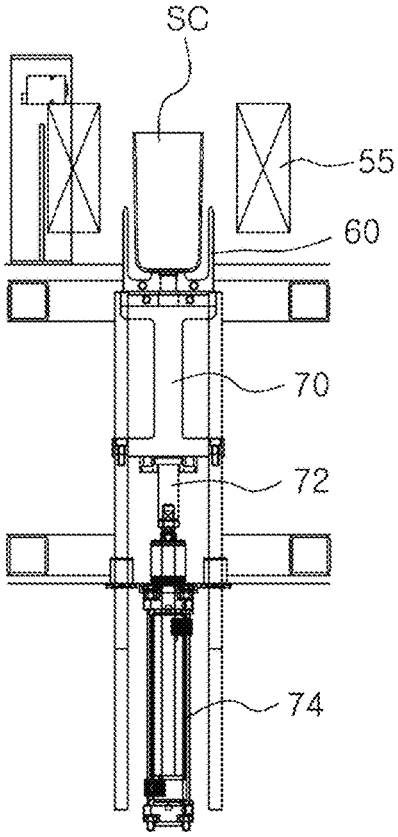
FIG. 2 is a schematic view of an electronic stirring unit which is one configuration of the high-quality semi-solid slurry manufacturing apparatus using optimized process parameters according to the embodiment of the present invention.

FIG. 1 is a configuration block diagram of the high-quality semi-solid slurry manufacturing apparatus using optimized process parameters according to the embodiment of the present invention, and FIG. 2 is a schematic view of an electronic stirring unit which is one configuration of the high-quality semi-solid slurry manufacturing apparatus using optimized process parameters according to the embodiment of the present invention.

Figure 3:
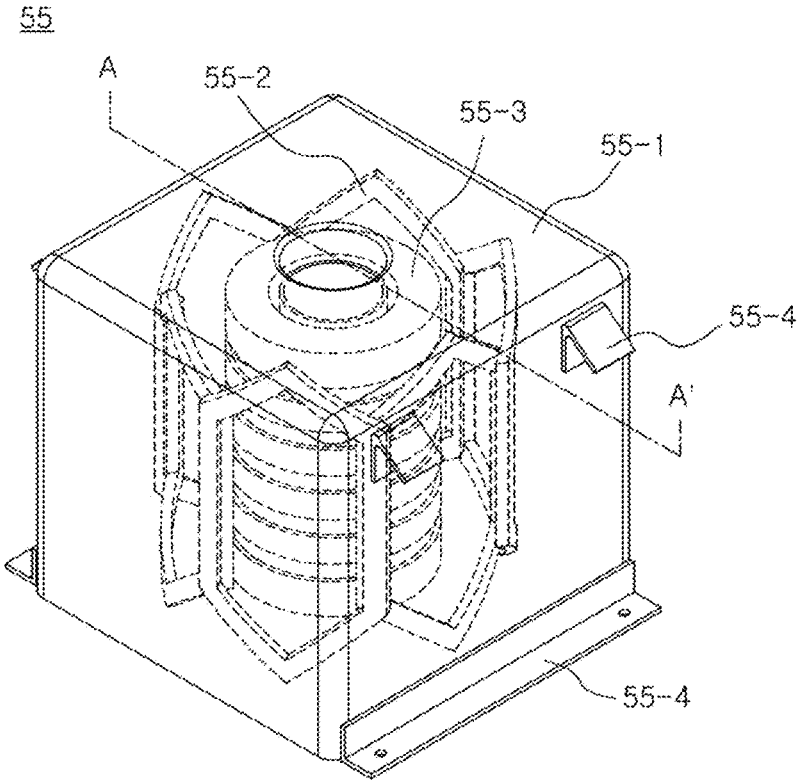
FIG. 3 is a projected perspective view of an electromagnetic field applying device of the electronic stirring unit of FIG. 2.
Figure 4:
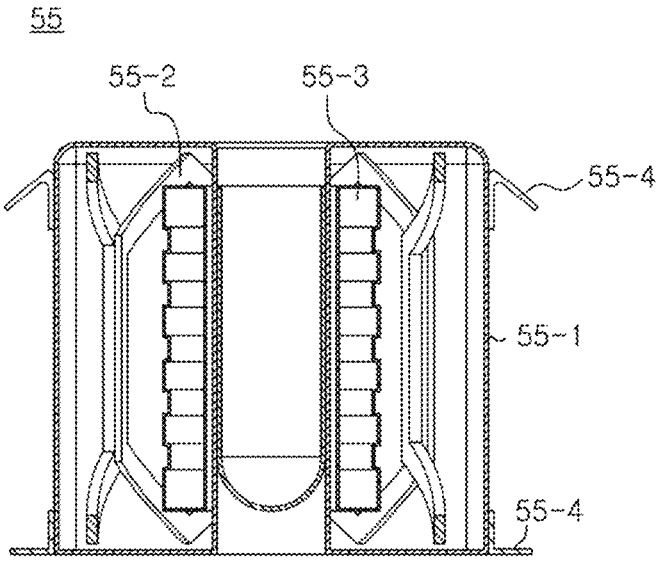
FIG. 4 is a cross-sectional view of the electromagnetic field applying device taken along line A-A' of FIG. 3.

In addition, FIG. 3 is a projected perspective view of an electromagnetic field applying device of the electronic stirring unit of FIG. 2, and FIG. 4 is a cross-sectional view of the electromagnetic field applying device of FIG. 3.

Referring to FIGS. 1 to 4, the high-quality semi-solid slurry manufacturing apparatus using optimized process parameters according to the present invention relates to an apparatus of manufacturing a semi-solid slurry using a slurry cup and can include a high-pressure washing unit 10, a release agent coating unit 20, a preheating unit 30, an injection unit 40, and an electronic stirring unit 50.

Specifically, the high-pressure washing unit 10 washes and cools a slurry cup prior to using the slurry cup and can rapidly cool the slurry cup while washing the inside of the slurry cup by using a high-pressure air blow.

Here, cooling the slurry cup is unnecessary during an initial operation, but after one cycle for manufacturing a slurry, a temperature of the slurry cup is increased by a molten metal and a surface thereof becomes very hot, and thus, cooling the slurry cup is required when intending to repeat a cycle after one cycle for manufacturing a slurry.

In addition, cleaning the inside of the slurry cup is an important process to determine quality of a semi-solid slurry to be manufactured, and when a foreign substance is introduced into the slurry cup into which the molten metal flows, the foreign substance is eventually introduced into the molten metal to form pores, and there is room for cracks to occur as a structure becomes unbalanced by the pores, and thus, it is important to block the foreign substance from the inside of the slurry cup.

At this time, the high-pressure washing unit 10 is formed to strongly wash the inside of the slurry cup by using high-pressure air blow and at the same time cool the heated internal and external surfaces of the slurry cup to a predetermined temperature, and thus, there is no need to separately perform cooling and washing processes. Due to this, the processes can be simplified, and faster slurry can be manufactured.

Meanwhile, the high-pressure washing unit 10 can also spray the air blow and droplets to increase a cooling rate. To this end, the high-pressure washing unit 10 can be connected to a water supply unit (not illustrated), and water delivered from the water supply unit can be formed into droplets by high-pressure air and sprayed together with an air blow. Due to this, the droplets adhere to a surface of the slurry cup to absorb heat, and vaporizes, thereby rapidly reducing a temperature of the surface of the slurry cup.

The release agent coating unit 20 applies a release agent to the inside of the slurry cup where an internal foreign substance is removed and cooling is performed by the high-pressure washing unit 10, and the release agent applied to the inside of the slurry cup washes the inside of the slurry cup and forms a film between the manufactured slurry and the slurry cup to facilitate separation of the slurry.

Here, the release agent coating unit 20 can perform spraying by using general nozzles, and meanwhile, can also perform the application by including an ultrasonic vibration element (not illustrated). The ultrasonic vibration element enables ultrasonic spraying to widen a spraying range of the release agent, which allows the release agent to be evenly sprayed into the slurry cup.

The preheating unit 30 can preheat the slurry cup coated with the release agent by the release agent coating unit 20. Here, the preheating unit 30 can preheat the slurry cup to temperatures of 60° C. to 120° C. by emitting a high frequency wave by using a high-frequency wave generator, and by performing this process, a temperature difference between the surface of the slurry cup and the molten metal can be reduced when injecting the molten metal for manufacturing a slurry to enable a temperature inside and outside the molten metal to be formed uniformly and to be eventually solidified uniformly, and thus, a high-quality semi-solid slurry can be manufactured.

At this time, when a preheating temperature of the slurry cup is preheated to be less than 60° C., the release agent can flow down in a liquid phase when being applied to the slurry cup in order for the slurry cup not to be properly coated, and when the slurry cup is preheated to more than 120° C., the release agent can evaporate so as not to be properly applied to the slurry cup.

As such, when the release agent is not properly applied to the slurry cup, the molten metal quickly hardens on the surface of the slurry cup, which can cause a phenomenon in which separation of the semi-solid slurry is not easy.

The injection unit 40 can inject the molten metal into the preheated slurry cup from the preheating unit 30. Here, the injection unit 40 can inject the molten metal dissolved in a melting furnace into the slurry cup after ladling the molten metal, and for this, the injection unit 40 can be provided with a slurry cup fixing means 60 for holding or inserting so as to limit movement of the slurry cup and can also include a transfer unit (not illustrated) for transferring the ladled molten metal from the melting furnace when a distance between the slurry cup fixing means 60 and the melting furnace is long. Here, when the distance between the slurry cup fixing means 60 and the melting furnace is short, the molten metal can be directly injected into the slurry cup after being ladled, and thus, the transfer unit need not be included.

In addition, the injection unit 40 can also include a funnel unit (not illustrated) such that the molten metal is injected into the slurry cup more accurately and safely. The funnel unit can be configured to rotate to an upper portion of the slurry cup fixing means 60 to be used when molten metal is injected and can prevent the molten metal from splashing or flowing therearound such that all of the ladled molten metal is injected into the slurry cup.

Meanwhile, the injection unit 40 can inject the ladled molten metal into the slurry cup from the melting furnace at temperatures of 610° C. to 650° C. Here, when a temperature of the molten metal injected into the slurry cup is lower than 610° C., a structure is uniform, but a large amount of bubbles can exist in the slurry, and when the temperature exceeds 650° C., the structure is not uniform and can exist dendritically.

In addition, the molten metal can be aluminum alloy A356 which is a preferred example and is not necessarily limited thereto and can also be formed of another metal material.

In addition, in a case of a slurry cup, a thickness of 2 mm to 6 mm can be used. This is because, when the thickness of the slurry cup is less than 2 mm, a change in temperature on a surface of the slurry cup is rapid, and a temperature deviation of inner and outer portions of the molten metal becomes severe, uniform spheroidized particles are hard to be obtained, solidification of the outer portion of the molten metal progresses rapidly to make injection difficult, and when exceeding 6 mm, thermal conductivity is lowered to cause much time to be taken for solidification, and the inside and outside of the molten metal can be hard to be uniformly solidified.

That is, when the injection unit 40 injects the molten metal into the slurry cup having a thickness of 2 mm to 6 mm at an injection temperature of 610° C. to 650° C., structure spheroidization of a slurry to be manufactured is well made, and an advantage of ultra-uniformity is excellent.

The electronic stirring unit 50 accelerates nucleation by applying an electromagnetic force to the molten metal injected into the slurry cup SC to change the molten metal into a slurry before the molten metal is initially solidified near a surface of the slurry cup SC to form a dendritic structure, and to this end, as illustrated in FIG. 2, the electronic stirring unit 50 may include an electromagnetic field applying device 55 provided around the slurry cup fixing means 60, and a plunger 70 provided at a lower portion of the slurry cup fixing means 60 so as to adjust the slurry cup to a height corresponding to the electromagnetic field applying device 55 or separate the slurry cup from the slurry cup fixing means 60.

Specifically, the electromagnetic field applying device 55 can also apply an electromagnetic field simultaneously with the injection of the molten metal into the slurry cup or can also apply the electromagnetic field during the injection of the molten metal.

Through this, there is no growth from an initial solidified layer to a dendritic structure on the surface of the slurry cup of which temperature is relatively low despite being preheated, and fine crystal nuclei are simultaneously generated in the entire slurry cup, and the entire molten metal in the slurry cup is cooled uniformly and rapidly to just below a liquidus temperature, and multiple crystal nuclei can be generated at the same time.

This is because, the internal molten metal and the molten metal on the surface are well stirred due to the active initial stirring action by applying an electromagnetic field before or at the same time as the molten metal is injected into a slurry manufacturing region, and thus, heat transfer occurs quickly in the molten metal, and formation of an initial solidification layer is reduced on the surface of the slurry cup.

In addition, convective heat transfer between a well-stirred molten metal and a surface of the slurry cup at a relatively low temperature increases, to rapidly cool a temperature of the entire molten metal. That is, the injected molten metal is dispersed as dispersed particles by electromagnetic field stirring at the same time as the injection, and the dispersed particles are uniformly distributed in the slurry cup as crystal nuclei, and thereby, a temperature difference does not occur in the entire slurry cup.

This is different from the related art in which the injected molten metal comes into contact with the surface of the slurry cup at a low temperature to grow into a dendritic crystal from an initial solidification layer on the surface of the slurry cup by rapid convective heat transfer.

The electromagnetic field applying device 55 can be provided in a case 55-1 for protection from the outside and can include an electromagnetic stirring (EMS) 55-2 and an electromagnet 55-3.

Here, an electromagnetic field can be generated by an interaction between the EMS 55-2 and the electromagnet 55-3 and can be formed to cause stirring in a horizontal or vertical direction to be made. In addition, as illustrated in the drawing, a binding member 55-4 can also be provided in the case 55-1.

A plunger 70 can be connected to a piston rod 72 that moves up and down by an operation of a drive unit 74 to move up and down, and a slurry cup seating portion can be provided in an upper portion thereof to adjust the slurry cup SC to a height corresponding to the electromagnetic field applying device 55 for electromagnetic stirring or to operate to separate the SC in which the electromagnetic stirring is completed, from the slurry cup fixing means 60.

In addition, the drive unit 74 can be provided with a drive motor and a gear device or a pneumatic cylinder or a hydraulic cylinder and can be driven by a power device (not illustrated) electrically connected to a control unit.

The electronic stirring unit 50 can accurately adjusting a heat extraction rate and a shearing action without limitation of mechanical stirring through electronic stirring to represent uniformity of a temperature distribution and reduce a work time and represent an advantage of easy connection to a subsequent process and particularly, reduce interference of gas, impurity, oxide, and so on, and thus, high-quality sphere and structure can be obtained.

At this time, the electronic stirring can be made for 10 seconds to 30 seconds, which is because, when stirring is made within a range of 10 seconds to 30 seconds, a structure size, spheroidization, and uniformity are appropriate and a bubble generation rate is very low, and thus, an excellent structure is provided, and when stirring is made for time less than 10 seconds, there is severe structure imbalance to exist as a dendritic phase, and when exceeding 30 seconds, the effect is the same, but economic efficiency is reduced because the stirring time is long.

Meanwhile, an up-down movement of the slurry cup performed by the above-described slurry cup fixing means 60, the plunger 70, and the drive unit 74 are described by using the electronic stirring unit 50 for the sake of better understanding, but in addition to the electronic stirring unit 50, the up-down movement can also be applied to the high-pressure washing unit 10, the release agent coating unit 20, the preheating unit 30, and the injection unit 40 that require an up-down movement for fixing and separating the slurry cup.

That is, high-pressure washing, release agent coating, preheating, molten metal injection, and so on can also be performed with the slurry cup fixed in the high-pressure washing unit 10, the release agent coating unit 20, the preheating unit 30, and the injection unit 40, and the slurry cup can be fixed, released, and separated repeatedly by the slurry cup fixing means 60 and the plunger 70 provided in each unit and sequentially progressed up to electromagnetic stirring, and thereby, the slurry is completely formed.

In addition, in another form, the slurry cup fixing means 60 and the plunger 70 can also be provided in one or more places rather than being provided one by one for each unit, and a device performing each operation of the high-pressure washing unit 10, the release agent coating unit 20, the preheating unit 30, and the injection unit 40 can also be formed to move in a direction of the slurry cup fixing means 60 and the plunger 70.

For example, after one slurry cup is mounted on the slurry cup fixing means 60, an air blow device of the high-pressure washing unit 10 can move to an upper side of the mounted slurry cup to perform high-pressure washing and cooling, and release agent coating nozzles can sequentially move to the upper side of the slurry cup to coating the slurry cup with a release agent, and preheating means of the preheating unit, injection means of the injection unit 40, and so on can sequentially operate in this way such that all processes are performed in one place. Thereafter, the electronic stirring is completed, and then the plunger 70 is finally operated to separate the slurry cup from the slurry cup fixing means 60, and thereby, the processes are minimized.

As such, an up-down movement method using the plunger 70 can be applied in one or more of the high-pressure washing unit 10, the release agent coating unit 20, the preheating unit 30, the injection unit 40, and the electronic stirring unit 50, and a plurality of units can also pass through one or more plungers 70.

In addition, the high-pressure washing unit 10 and the release agent coating unit 20 can fix the slurry cup in a reverse direction and enable each nozzle to be inserted into the slurry cup and enable high-pressure washing, cooling, and release agent coating to be performed inside the slurry cup. Thereby, a foreign substance, a release agent, and so on can be prevented from remaining inside the slurry cup, and there is an advantage in that process efficiency such as removing the foreign substance and applying the release agent can be increased. However, fixing the high-pressure washing unit 10 and the release agent coating unit 20 in a reverse direction is not limited thereto, and the high-pressure washing unit 10 and the release agent coating unit 20 can be fixed in a forward direction.

When the slurry cup is fixed in the forward direction, the slurry cup can be configured to rotate after an angle of the fixed slurry cup is adjusted in addition to an up-down movement operation of the slurry cup, and thus, high-pressure washing and cooling, application of a release agent, and so on can be made more uniformly over the entire surface of the slurry cup.

To this end, a lower portion of the slurry cup fixing means 60 that the slurry cup SC is held thereby or inserted thereinto can further include angle rotation adjustment portions 80 and 90 in addition to the plunger 70.

The angle rotation adjustment portions 80 and 90 will be described in detail with reference to FIGS. 5 to 9.

Figure 5:
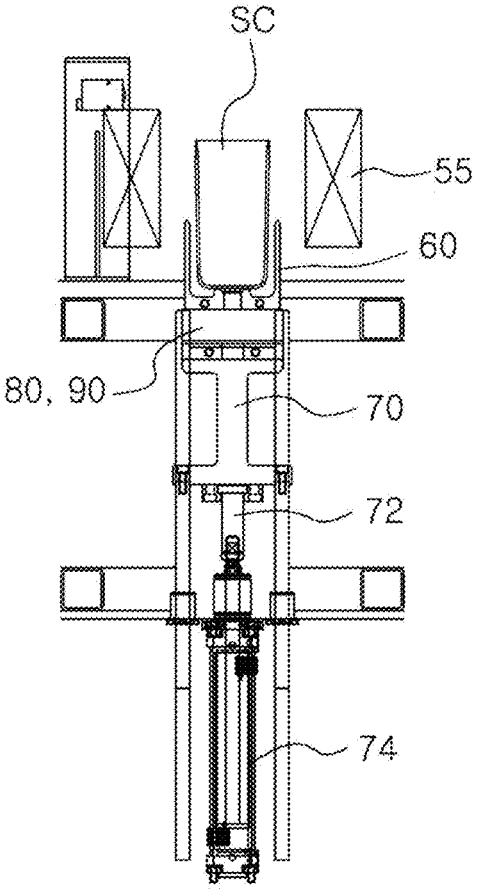
FIG. 5 is a view schematically illustrating installation positions of angle rotation adjustment portions which are one configuration of the high-quality semi-solid slurry manufacturing apparatus using optimized process parameters according to the embodiment of the present invention.

FIG. 5 is a view schematically illustrating installation positions of the angle rotation adjustment portions which are one configuration of the high-quality semi-solid slurry manufacturing apparatus using optimized process parameters according to the embodiment of the present invention.

Referring to FIG. 5, the angle rotation adjustment portions 80 and 90 can be provided above the plunger 70 when provided together with the plunger 70. However, the angle rotation adjustment portions 80 and 90 are not always provided together with the plunger 70, and only the plunger 70 can also be provided separately, or only the angle rotation adjustment portions 80 and 90 can also be provided separately.

That is, the plunger 70 and the angle rotation adjustment portions 80 and 90 can be separately provided and operate respectively or can be provided together and operate.

Figure 6:
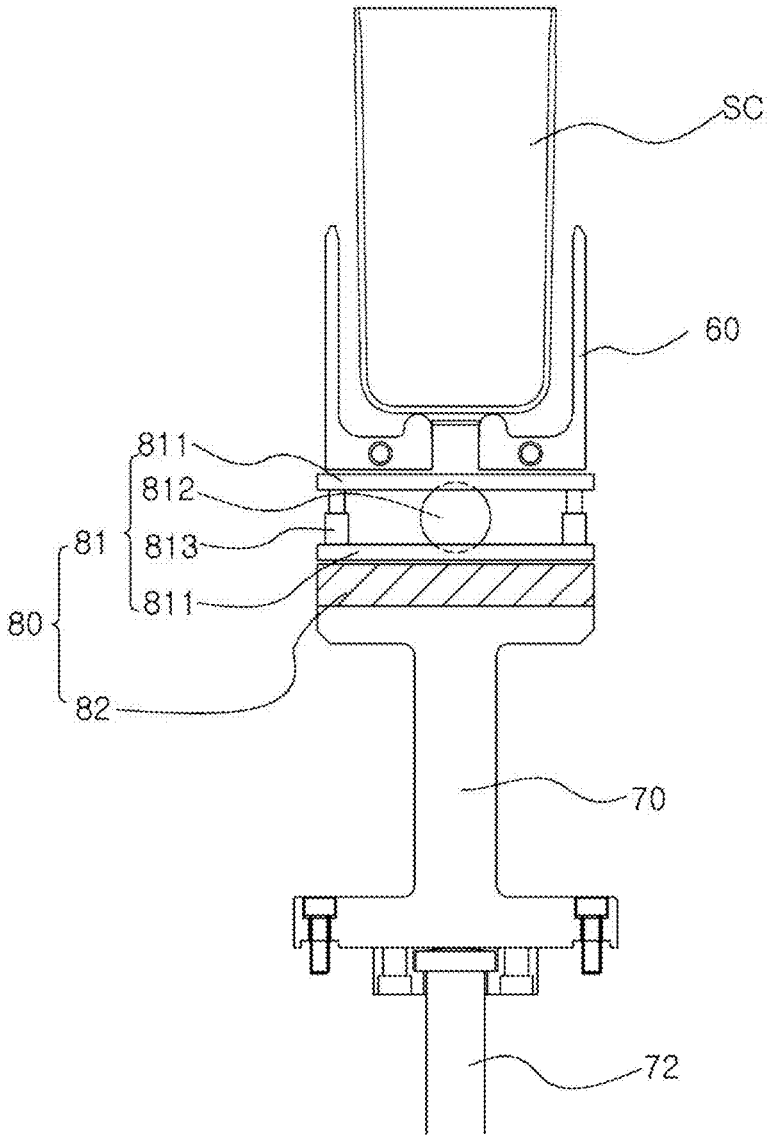
FIG. 6 is a view schematically illustrating an example of the angle rotation adjustment portion of FIG. 5.
Figure 7:
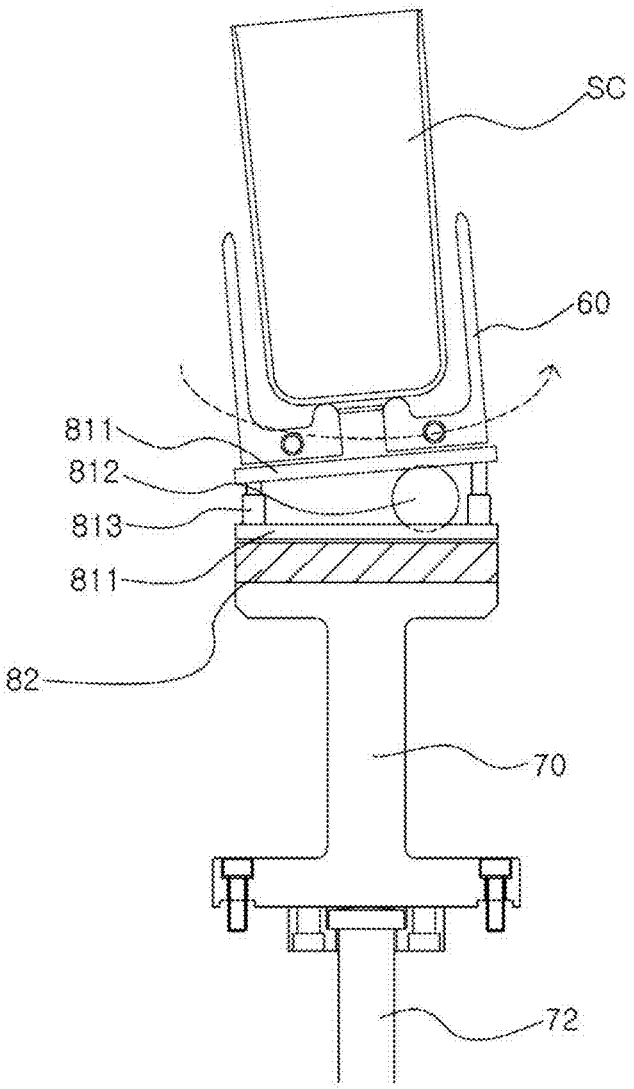
FIG. 7 is an example view of an operation of the angle rotation adjustment portion of FIG. 6.
Figure 8:
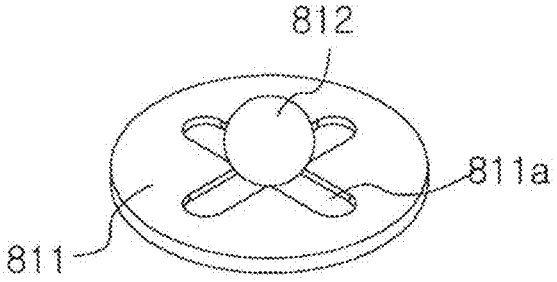
FIG. 8 is an example view illustrating a rotation plate body and an angle adjustment ball of the angle rotation adjustment portion of FIG. 6.

FIG. 6 is a view schematically illustrating an example of the angle rotation adjustment portion of FIG. 5, FIG. 7 is an example view of an operation of the angle rotation adjustment portion of FIG. 6, and FIG. 8 is an example view illustrating a rotation plate body and an angle adjustment ball of the angle rotation adjustment portion of FIG. 6.

Referring to FIGS. 6 to 8, for example, the angle rotation adjustment portion 80 can include a rotation unit 81 and a magnetic field control unit 82.

Specifically, the rotation unit 81 can be configured to be rotated by the magnetic field control unit 82 and provided with the magnetic field control unit 82 located thereunder and formed to rotate according to an application of a magnetic field of the magnetic field control unit 82.

Here, the rotation unit 81 can be provided with a plurality of movement grooves 811*a* forming a length in all directions from the center, and can include two rotation plate bodies 811 that are symmetrical up and down and connected to each other by a connection unit 813, and an angle adjustment ball 812 provided in the center between the two rotation plate bodies 811 and formed to move along one of the plurality of movement grooves 811*a* when a magnetic field is applied by the magnetic field control unit 82, and the connection unit 813 can be formed to be fluidly variable in height.

In the rotation unit 81 having this structure, when the angle adjustment ball 812 is located in the center of the two rotation plate bodies 811, the upper rotation plate body 811 is balanced, but when the angle adjustment ball 812 moves to one side according to the application of the magnetic field, the rotation plate body 811 on the other side is eccentric and freely falls with a height of the connection unit 813, and thereby, an angle of the slurry cup SC can be adjusted.

In this state, when a magnetic field is applied such that the angle adjustment ball 812 forms a reaction force, the angle adjustment ball 812, which is blocked from flowing in a circumferential direction, generates a force to rotate the entire rotation unit, and the slurry cup SC rotates in a state inclined to one side, and thus, washing, cooling, application of a release agent, and son can be performed.

Figure 9:
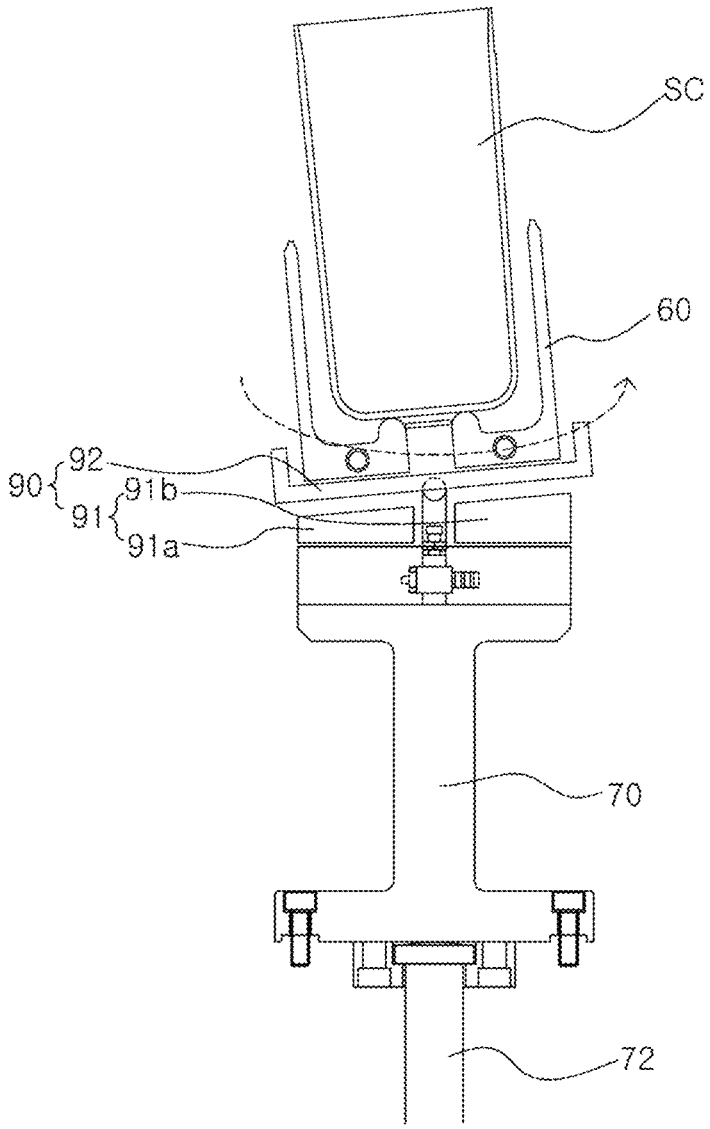
FIG. 9 is a view schematically illustrating another example of the angle rotation adjustment portion of FIG. 5 together with an operation example.

FIG. 9 is a view schematically illustrating another example of the angle rotation adjustment portion of FIG. 5 together with an operation example.

Referring to FIG. 9, the angle rotation adjustment portion 90 as another example includes a donut-shaped guide plate body 91 in which a low slope portion 91*a* is formed on one side and a high slope portion 91*b* is formed on the other side, and a rotation body 92 provided in the center of the guide plate body 91.

Here, the high slope portion 91*b* is a slope portion that is inclined in a high state compared to the low slope portion 91*a*, the low slope portion 91*a* is a slope portion that is inclined in a low state compared to the high slope portion 91*b*, the slurry cup SC is seated to encompass the rotation body 92 and the guide plate body 91 and is inclined in a direction of the low slope portion 91*a* and is rotated by the rotation body 92, and thus, an angle and a rotation are simultaneously adjusted.

Meanwhile, the rotation body 92 is preferably provided with a hinge, a flexible joint, and so on to have flexibility with respect to the angle adjustment of the slurry cup.

While the slurry cup is rotated in an inclined state to one side by the angle rotation adjustment portion 80 and 90 described above, washing, cooling, application of a release agent, and so on are performed for the slurry cup, and thus, the washing, the cooling, the application of release agent, and so on can be performed more uniformly over the entire surface including the corner of the slurry cup.

Figure 10:
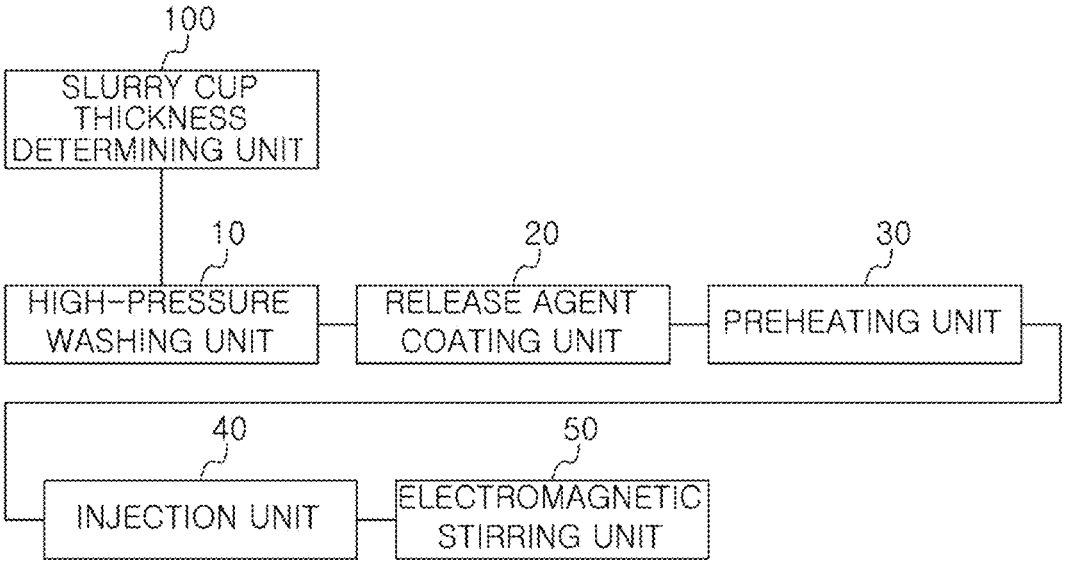
FIG. 10 is a configuration block diagram of the high-quality semi-solid slurry manufacturing apparatus using optimized process parameters according to the embodiment of the present invention, to which a slurry cup thickness determining unit is added.

FIG. 10 is a configuration block diagram of the high-quality semi-solid slurry manufacturing apparatus using optimized process parameters according to the embodiment of the present invention, to which a slurry cup thickness determining unit is added.

Referring to FIG. 10, the high-quality semi-solid slurry manufacturing apparatus according to the embodiment of the present invention can further include a slurry cup thickness determining unit 100.

The slurry cup thickness determining unit 100 determines a thickness of a slurry cup before removing a foreign substance from the inside of the slurry cup and performing cooling, that is, before passing through the high-pressure washing unit 10, and the slurry cup can be made of a one-faceted body, but a plurality of faceted bodies can also be layered for determining the thickness of the slurry cup. At this time, the faceted bodies can each have a thickness of 0.5 mm to 1 mm and can be overlapped in a plurality of layers and then fixed to achieve the same thickness as a one-faceted body. That is, a plurality of faceted bodies, each having a thickness of 0.5 mm to 1 mm thick, are layered to form a slurry cup having a thickness of 2 mm to 6 mm.

In addition, the slurry cup thickness determining unit 100 can also automatically analyze surrounding environmental factors including temperature and humidity around the high-quality semi-solid slurry manufacturing apparatus using optimized process parameters to notify an appropriate thickness and determine a thickness of a slurry cup according to the notified appropriate thickness. That is, an operator can recognize changes in the surrounding environmental factors such as ambient temperature and humidity through the slurry cup thickness determining unit 100 and know the appropriate thickness according to the changes, and the thickness of the slurry cup can be finally determined to be used by appropriately reflecting experience of the operator.

According to the slurry cup thickness determining unit 100, when the slurry cup is formed to have a one-faceted body, several slurry cups have to be provided for each thickness, but when the slurry cup is formed to have a plurality of faceted bodies, a thickness of the slurry cup can be adjusted by adjusting layers as needed, and thus, cost can be greatly reduced, and particularly, the thickness of the slurry cup can be quickly and easily adjusted for the ever-changing surrounding environment, and thus, an advantage of easily coping with environmental changes can be obtained.

Meanwhile, according to the high-quality semi-solid slurry manufacturing apparatus using optimized process parameters according to the embodiment of the present invention, all the above-described configurations, that is, the high-pressure washing unit 10, the release agent coating unit 20, the preheating unit 30, the injection unit 40, the electronic stirring unit 50, and so on, devices or means constituting the present invention can be naturally controlled by a control unit (not illustrated).

Figure 11A:
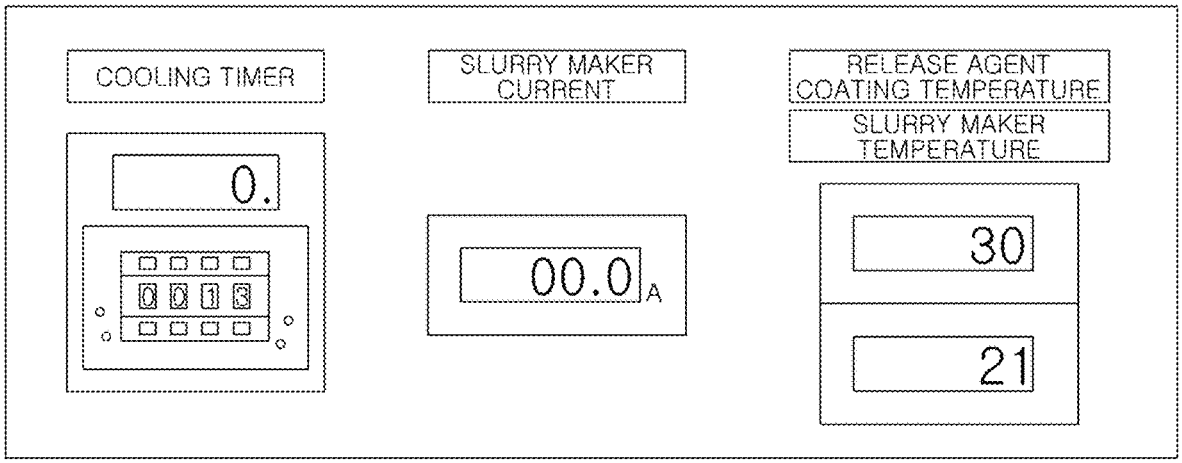
FIGS. 11A and 11B are example pictures of a control unit of the high-quality semi-solid slurry manufacturing apparatus using optimized process parameters according to the embodiment of the present invention.
Figure 11B:
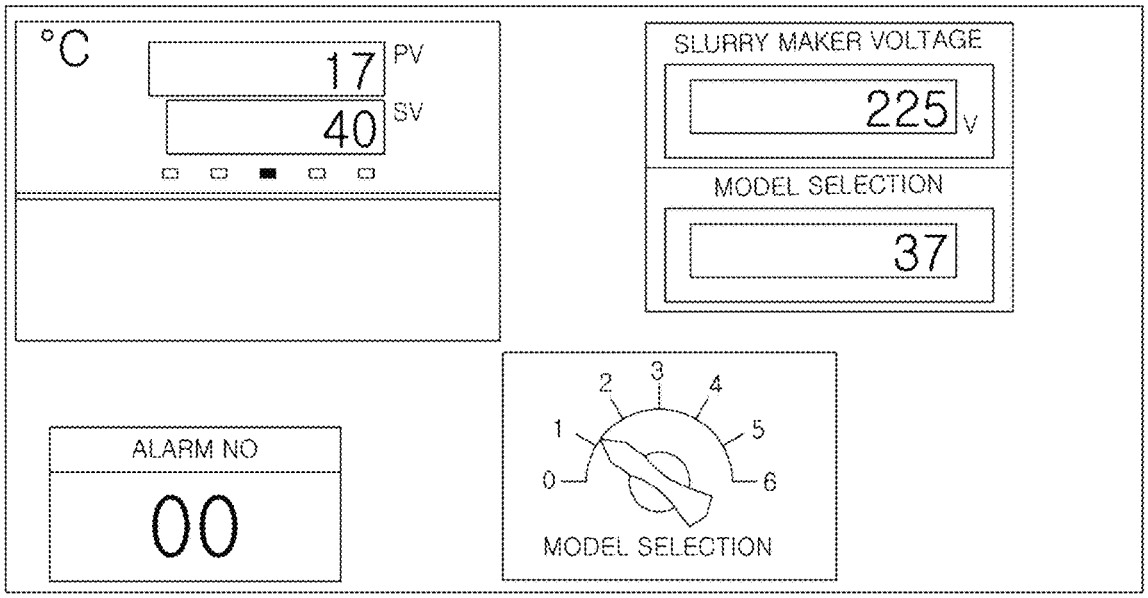

FIGS. 11A and 11B are example pictures of a control unit of the high-quality semi-solid slurry manufacturing apparatus using optimized process parameters according to the embodiment of the present invention.

Referring to FIGS. 11A and 11B, the control unit can control all parameters such as a voltage, a current, a process time, and a temperature throughout slurry manufacturing, and quality of a semi-solid slurry can be constant at all times by more precise and automatic processing.

Specifically, referring to FIG. 11A, a cooling time of the molten metal can be controlled, and a current applied to the slurry manufacturing can be controlled. In addition, a release agent application temperature and a temperature according to the slurry manufacturing can be kept constant according to setting thereof.

In addition, referring to FIG. 11B, a voltage and a voltage application time during slurry manufacturing can be precisely controlled and kept constant, and the number of processes can be counted. That is, process parameters such as a voltage, a current, and a stirring time of the electronic stirring unit 50 can be easily set and adjusted by the control unit.

The present invention can uniformly promote nucleation of a slurry of the electromagnetic field applying device 55 by easily setting and adjusting and by constantly maintaining process parameters of the electronic stirring unit 50, thereby achieving a high quality and a uniform quality of the slurry.

In addition, although not illustrated in FIGS. 11A and 11B, a preheating temperature and so on can be controlled, and various parameters in addition to the above-described slurry manufacturing parameters can be automatically adjusted to keep constant.

As described above, the high-quality semi-solid slurry manufacturing apparatus using optimized process parameters according to the embodiment of the present invention can easily set parameters that can optimize a structure of a semi-solid slurry for achieving a high quality, and constant maintenance can be made according to the set items, and thus, there is an advantage in that quality and productivity of the semi-solid slurry can be increased.

In addition, the high-quality semi-solid slurry manufacturing apparatus using optimized process parameters according to the embodiment of the present invention can further include a separation unit 110 and a molding unit 120 to form a component manufacturing system. This will be described with reference to FIGS. 12 to 15.

Figure 12:
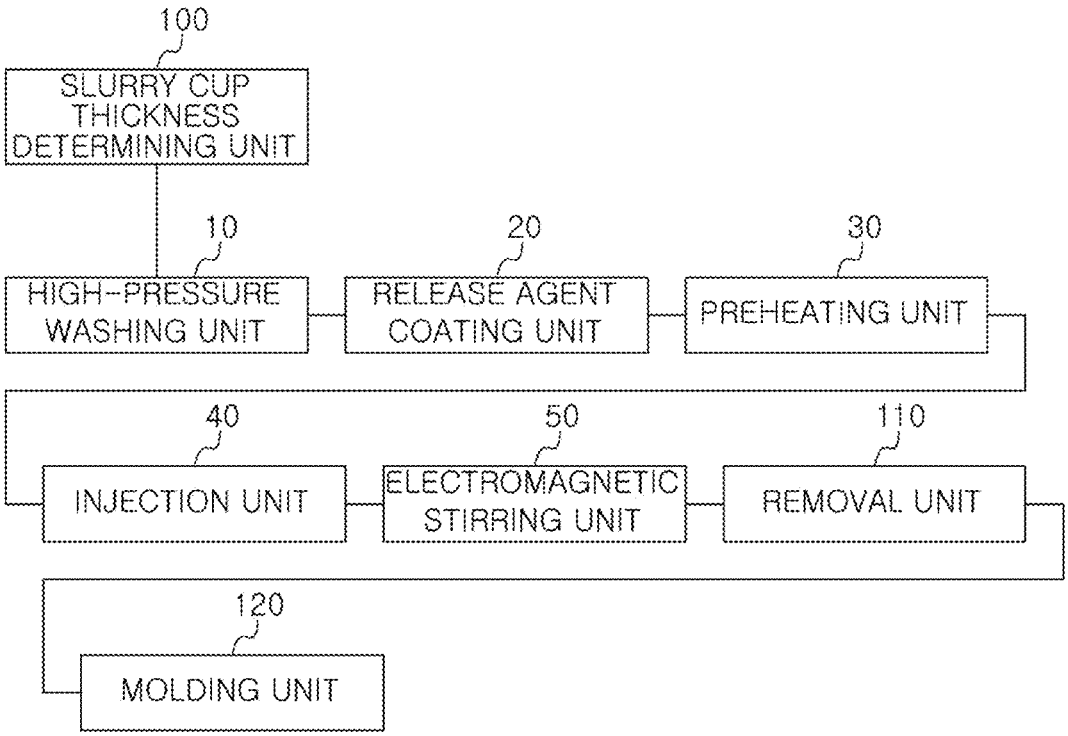
FIG. 12 is a configuration block diagram of a component molding system including the high-quality semi-solid slurry manufacturing apparatus using optimized process parameters according to the embodiment of the present invention.
Figure 13:
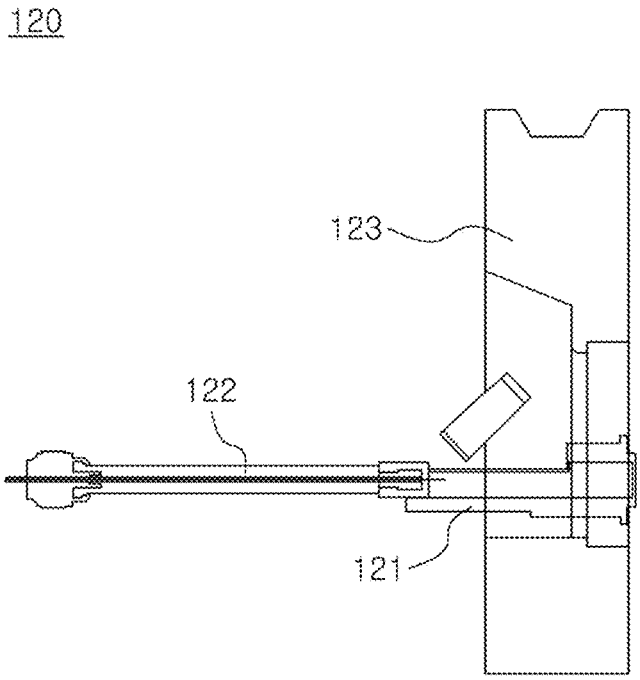
FIG. 13 is a schematic view illustrating a molding unit of the component molding system of FIG. 12.
Figure 14A:
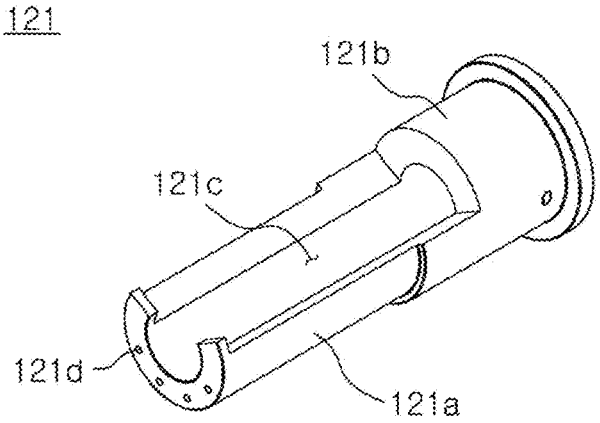
FIGS. 14A and 14B are respectively a perspective view and a side view illustrating an injection sleeve which is one configuration of the component molding system of FIG. 13.
Figure 14B:
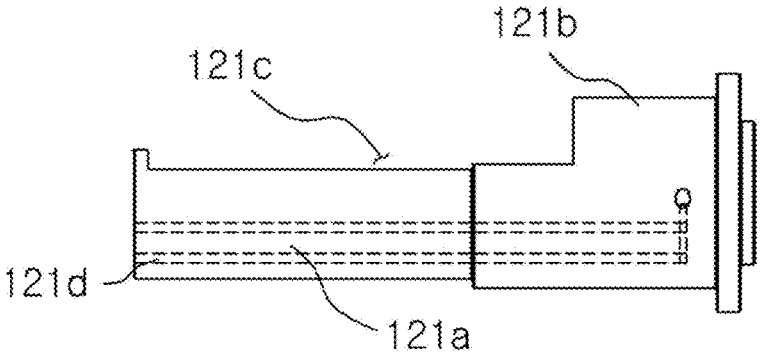
Figure 15:
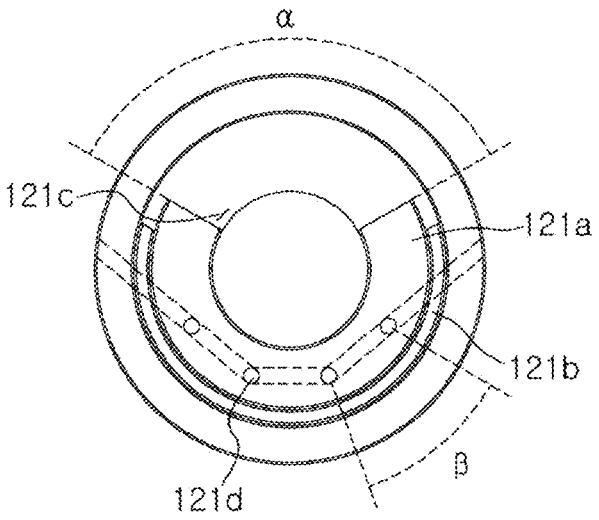
FIG. 15 is a projected perspective view illustrating the injection sleeve of FIG. 14A.

FIG. 12 is a configuration block diagram of a component molding system including the high-quality semi-solid slurry manufacturing apparatus using optimized process parameters according to the embodiment of the present invention, FIG. 13 is a schematic view illustrating a molding unit of the component molding system of FIG. 12, FIGS. 14A and 14B are respectively a perspective view and a side view illustrating an injection sleeve which is one configuration of the component molding system of FIG. 13, and FIG. 15 is a front cross-sectional view illustrating the injection sleeve of FIG. 14A.

Referring to FIGS. 12 to 15, the component manufacturing system according to an embodiment of the present invention can include a semi-solid slurry manufacturing apparatus, the separation unit 110, and the molding unit 120.

Here, the semi-solid slurry manufacturing apparatus is the semi-solid slurry manufacturing apparatus described with reference to FIGS. 1 to 11, and detailed descriptions thereof are omitted, and only the separation unit 110 and the molding unit 120 having a difference will be described.

The separation unit 110 can separate a manufactured semi-solid slurry from a slurry cup by transferring the slurry cup in which a semi-solid slurry is manufactured.

That is, the separation unit 110 can transfer the slurry cup from the electronic stirring unit 50 to the molding unit 120, separate the semi-solid slurry from the slurry cup, and inject the semi-solid slurry into an injection sleeve of the molding unit 120.

At this time, the separation unit 110 can be provided with a robot arm to easily move the slurry cup to the molding unit 120 immediately after electronic stirring of the electronic stirring unit 50 is completed but is not limited thereto and can be configured with various devices.

The molding unit 120 can receive the manufactured semi-solid slurry from the separation unit 110 and inject the semi-solid slurry into the injection sleeve 121 to mold a component.

That is, when the semi-solid slurry is injected into the injection sleeve 121 as illustrated in FIG. 13 of the molding unit 120, a pressure cylinder 122 is inserted into the injection sleeve 121 to pressurize the semi-solid slurry and inject the semi-solid slurry into the molding device 123, and thereby, the component can be manufactured.

Here, the injection sleeve 121 is a place into which the semi-solid slurry from the separation unit 110 is injected and does not interfere the semi-solid slurry when the semi-solid slurry is loaded and prevents a temperature of the semi-solid slurry from being reduced, and thus, quality of the molded component can be prevented from being reduced.

To this end, as illustrated in FIGS. 14 and 15, the injection sleeve 121 can include a sleeve body 121*a*, a bush 121*b*, an injection hole 121*c*, and a heating wire portion 121*d*.

The sleeve body 121*a* can be formed in a cylindrical shape having a hollow therein, and the pressure cylinder 122 can be inserted into the sleeve body 121*a* on a front side.

The bush 121*b* has a cylindrical shape having a hollow therein and can extend from a rear surface of the sleeve body 121*a* to be formed integrally with the sleeve body 121*a*, and the pressure cylinder 122 can be inserted into the bush 121*b*.

In addition, the bush 121*b* can be installed in the molding device 123 such that the injection sleeve 121 is fixed to the molding device 123.

The injection hole 121*c* can be formed to have a length from an upper portion of the front side of the sleeve body 121*a* to an upper portion of the front side of the bush 121*b* such that the sleeve body 121*a* and part of the upper portion of the bush 121*b* are opened.

At this time, as illustrated in FIG. 15, the injection hole 121*c* can be formed to be opened symmetrically in a sector shape from the center of the front side of the sleeve body 121*a*.

In addition, an angle α of the injection hole 121*c* formed in a sector shape and can be formed in a range of 110 degrees to 130 degrees and preferably formed in 120 degrees.

It is designed to facilitate injection of the semi-solid slurry into the injection sleeve 121 from the separation unit 110 through the injection hole 121*c*.

The heating wire portion 121*d* maintains the injection sleeve 121 at a constant temperature to prevent a temperature of the injected semi-solid slurry from being rapidly reduced and from being changed, and thus, quality of the molded component can be prevented from being reduced.

At this time, the heating wire portion 121*d* can maintain the injection sleeve 121 at about 190° C. to 210° C. and preferably at 200° C.

The heating wire portion 121*d* can include a plurality of heating wires installed to be spaced apart from each other by a certain angle β in the center of a front side of the sleeve body 121*a* along a circumference in a lower portion inside the sleeve body 121*a* and the bush 121*b*, and the plurality of heating wires can be connected to each other in a zigzag form.

As illustrated in FIG. 15, four heating wires can be preferably installed, and at this time, the certain angle β spaced apart along the circumference can be 35 degrees to 45 degrees and be more preferably 40 degrees.

In addition, each of the heating wires can have a diameter of Φ7 to Φ9 and preferably Φ8.

When formed in this way, the injection sleeve 121 can be uniformly heated on the whole to effectively maintain a temperature thereof.

The molding unit 120 can be provided with a casting mold device to manufacture a component by using the semi-solid slurry but is not limited thereto, and various molding devices can be applied thereto.

Components to be manufactured here are preferably automobile components but are not limited thereto and can be applied to components, products, and so on in various fields.

Hereinafter, a semi-solid slurry manufacturing method will be described by using the high-quality semi-solid slurry manufacturing apparatus using the above-described optimized process parameters.

Figure 16:
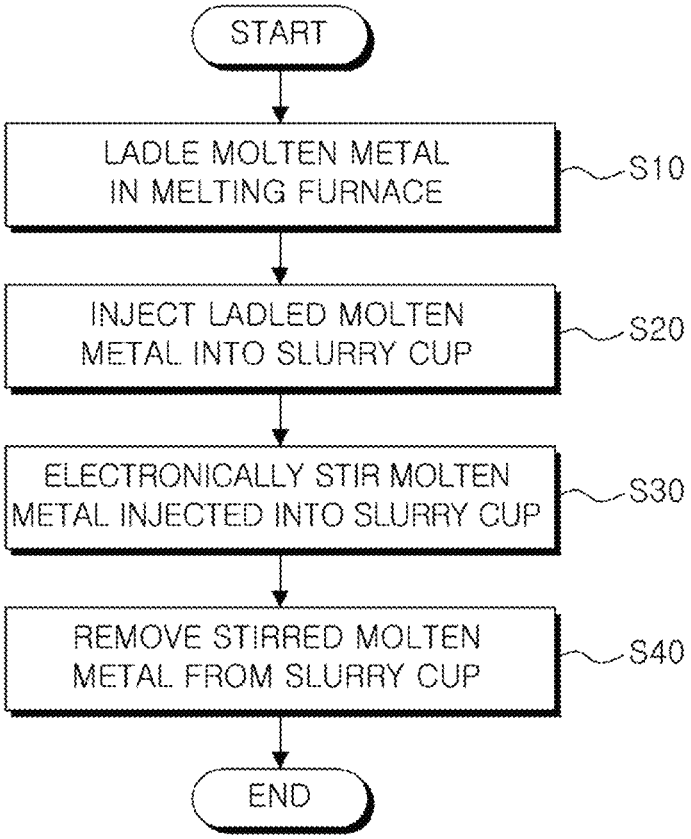
FIG. 16 is a flowchart of a high-quality semi-solid slurry manufacturing method using optimized process parameters according to an embodiment of the present invention.

FIG. 16 is a flowchart of a high-quality semi-solid slurry manufacturing method using optimized process parameters according to an embodiment of the present invention.

The semi-solid slurry manufacturing method according to the embodiment of the present invention relates to a high-quality semi-solid slurry manufacturing method using optimized process parameters in which a slurry structure obtains fine and uniform spheroidized particles for excellent product quality, and referring to FIG. 16, the high-quality semi-solid slurry manufacturing method using optimized process parameters according to an embodiment of the present invention includes (a) step of ladling a molten metal in a melting furnace (S10), (b) step of injecting the ladled molten metal into a slurry cup (S20), (c) step of electronically stirring the molten metal injected into the slurry cup (S30), and (d) step of separating the stirred molten metal from the slurry cup (S40).

Specifically, ladling is an operation of scooping out a molten metal heated and maintained at a temperature within a certain range in a melting furnace, and in step S10 of ladling the molten metal in the melting furnace, a certain amount of molten metal for casting that exists in a liquid phase above a melting point can be loaded by using a ladle which is a container for scooping the molten metal, and then, can be transferred to a place where the slurry cup is loaded.

Here, the molten metal can be aluminum alloy A356, but this is an example and not limited thereto.

In the step S20 of injecting the ladled molten metal into the slurry cup, the injection can be performed after the molten metal is cooled to an appropriate injection temperature. Here, the appropriate injection temperature of the molten metal is 610° C. to 650° C., which is described in the semi-solid slurry manufacturing apparatus, and thus, descriptions thereof are omitted below.

In addition, the slurry cup can have a thickness of 2 mm to 6 mm, which is also described in the semi-solid slurry manufacturing apparatus, and thus, detailed descriptions thereof are omitted.

That is, when the molten metal is injected into a slurry cup having a thickness of 2 mm to 6 mm at an injection temperature of 610° C. to 650° C., structure spheroidization of a slurry is well made, and an advantage of ultra-uniformity can be achieved.

In addition, in step S20 of injecting the ladled molten metal into the slurry cup, the molten metal can also be injected into a preheated slurry cup when the molten metal is injected, and a preheating temperature of the slurry cup can be temperatures of 60° C. to 120° C. for the same reason as described in the semi-solid slurry manufacturing apparatus.

The molten metal injected into the slurry cup can become a slurry through step S30 of performing electronic stirring, and specifically, can become a semi-solid slurry by generating an electromagnetic force and promoting nucleation before a dendritic structure is formed in which the molten metal injected into the slurry cup is solidified near a surface of the slurry cup.

Here, mechanical stirring has limitations in terms of wear of a stirrer, interference of impurities, reduction of quality, difficulty of process control, economic feasibility, and so on, and has a limitation in that fluidity of a slurry is low due to a limited space formed between the stirrer and a stirring vessel and continuous casting is not easy to cause a connection to a subsequent process to be difficult, and in contrast to this, electronic stirring does not have the limitations of the above-described mechanical stirring, and thus, temperature distribution can be uniformly made by accurately adjusting a heat extraction rate and a shearing action, work time can be reduced, and a connection to the subsequent process is easy, and particularly, gases, impurities, oxides, and so on can be prevented from being introduced to enable a high-quality spheroidized structure to be obtained.

The electronic stirring can be performed for 10 seconds to 30 seconds according to the embodiment of the present invention, and such a reason is the same as described in the semi-solid slurry manufacturing apparatus according to the embodiment of the present invention.

Meanwhile, stirring is to generate an electromagnetic force before the dendritic structure is formed, and electromagnetic stirring can be performed before injection of the molten metal is completed. That is, an electromagnetic field applied to a slurry cup for electronic stirring of the molten metal is generated before the molten metal is injected or while the molten metal is being injected, and the electronic stirring can also be performed form a time point before the injection of the molten metal into the slurry cup is completed.

Due to this, stirring between an inside and a surface of the molten metal injected into the slurry cup is well made by an active initial stirring action on the slurry cup to cause heat to be quickly transferred in the molten metal, and thus, there is an advantage that formation of an initial solidification layer on an inner wall of the slurry cup can be suppressed. A specific principle thereof is described in the detailed description of the semi-solid slurry manufacturing apparatus according to the embodiment of the present invention.

Meanwhile, the stirring time can be 10 seconds to 30 seconds as described above and can be 10 seconds to 30 seconds from the time when the injection of the molten metal is completed, regardless of the stirring time for injection of the molten metal. That is, even when the stirring starts before the injection of the molten metal, the stirring time is 10 seconds to 30 seconds from the time when the injection of the molten metal is completed, and even when the stirring is made while the injection of the molten metal is in progress, the stirring time can be 10 seconds to 30 seconds from the time when the injection of the molten metal is completed.

When the stirring step S30 is completed as described above, a semi-solid slurry can be completed through step S40 of separating the stirred molten metal, that is, the semi-solid slurry from the slurry cup, and high-quality automobile components and so on can be manufactured by using a component molding system according to an embodiment of the present invention using the semi-solid slurry.

At this time, the molten metal for manufacturing the semi-solid slurry can contain improved additives of 4 wt % to 6 wt % of aluminum (Al), 0.5 wt % to 1.5 wt % of titanium (Ti), and 0.005% to 0.015% of boron (B) based on 100 wt % of the total weight.

The semi-solid slurry containing the improved additive can have a smaller particle size compared to an additive not containing the improved additive, and a particle density, spheroidization, and contiguity thereof are improved, and thus, a metal structure advantageous for mechanical properties can be exhibited.

Hereinafter, in order to describe in more detail the high-quality semi-solid slurry manufacturing method using optimized process parameters according to the embodiment of the present invention, the following experimental examples are presented, but the following experimental examples are merely illustrative of the present invention and does not limit the present invention.

Experimental Example 1

Derivation of Optimum Conditions for High Quality Semi-Solid Slurry

A slurry manufacturing test was conducted for deriving optimal conditions when manufacturing a semi-solid slurry. The slurry manufacturing test was performed by analyzing quality of the semi-solid slurry according to each condition while variously changing conditions for a temperature of a molten metal injected into the slurry cup, an EMS stirring time, a slurry cup preheating temperature, and a slurry cup thickness.

The temperature of molten metal injected into the slurry cup was adjusted at 600° C. to 670° C., the EMS stirring time was adjusted from 5 seconds to 40 seconds, the slurry cup preheating temperature was adjusted to within and outside 60° C. to 120° C., and the slurry cup thickness was set to 2 mm and 7 mm.

In addition, a slurry formability test through an appearance inspection and an internal defect inspection, temperature distribution analysis through a thermal imaging camera, microstructure observation through a spheroidization rate, a structure size, and bubble content were conducted for quality analysis of the semi-solid slurry, and the appearance inspection was visually performed, and the internal defect inspection was performed by using an X-Ray.

The results are illustrated in FIGS. 17 to 30.

1. Visual Inspection

Figure 17A:
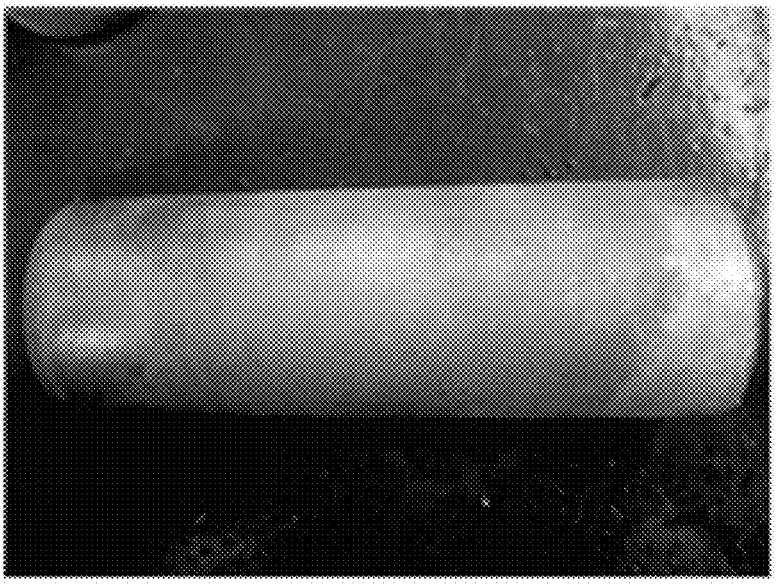
FIGS. 17A and 17B are example pictures of an appearance inspection of a semi-solid slurry.
Figure 17B:
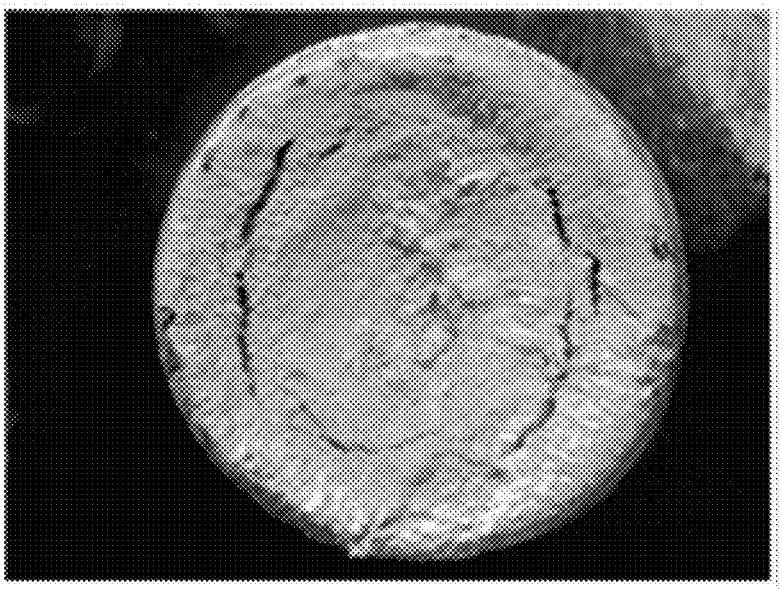
Figure 18:
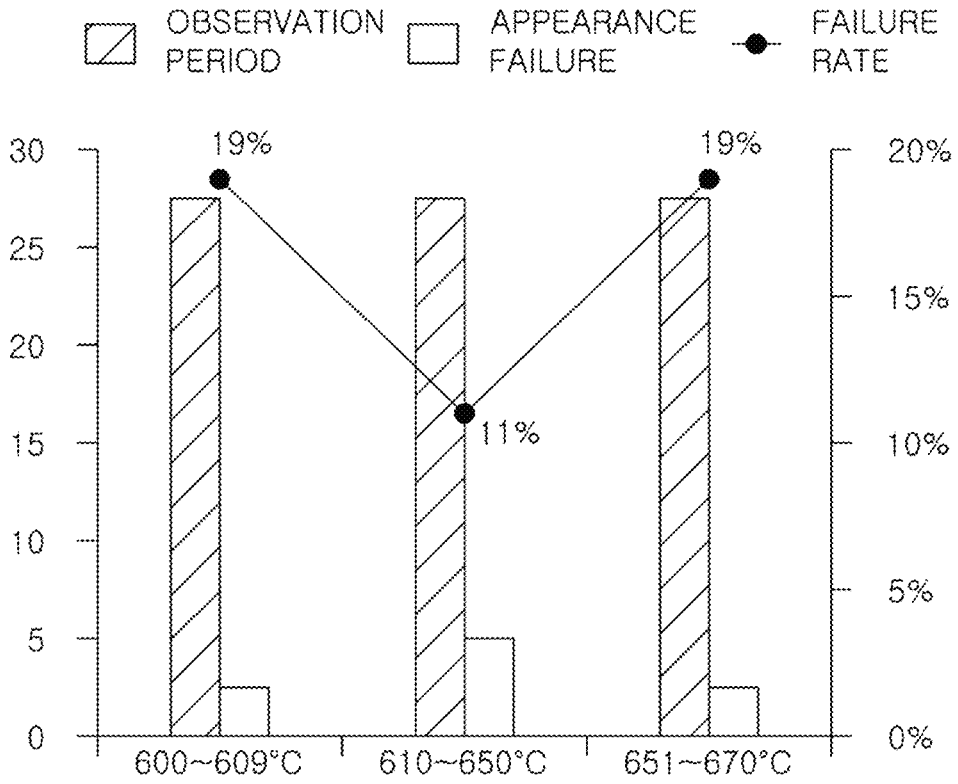
FIG. 18 is a graph illustrating results of the appearance inspection according to a change in a temperature of a molten metal injected into a slurry cup.
Figure 19:
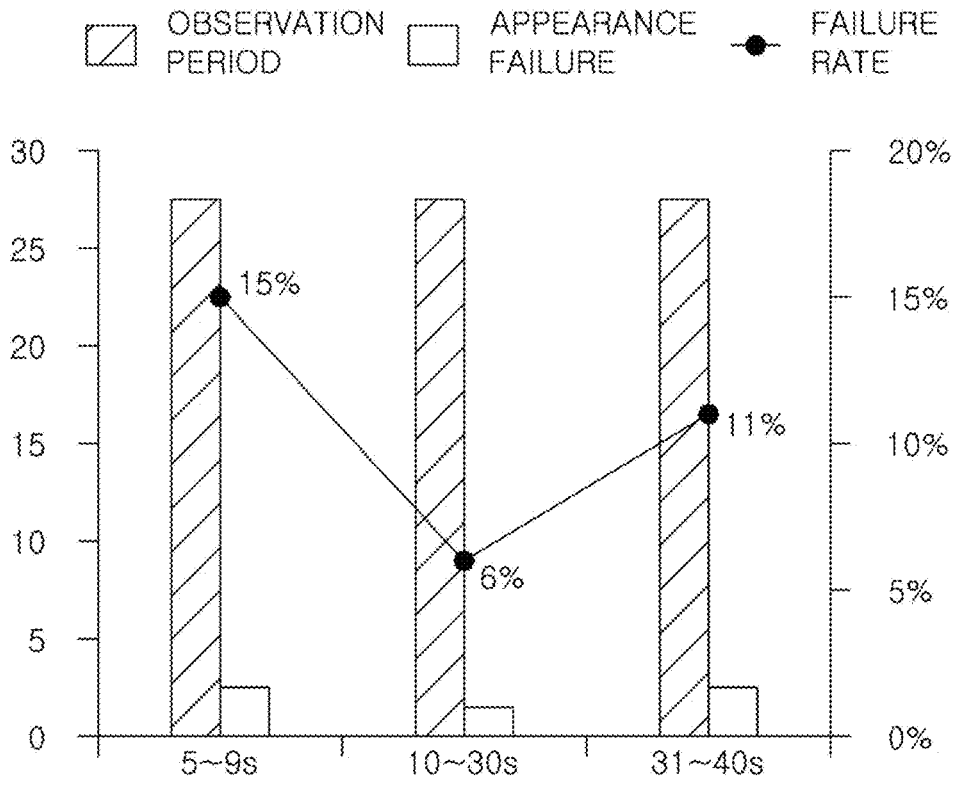
FIG. 19 is a graph illustrating the results of the appearance inspection according to a change in an EMS stirring time.

FIGS. 17A and 17B are example pictures of an appearance inspection of a semi-solid slurry, FIG. 18 is a graph illustrating results of the appearance inspection according to a change in a temperature of a molten metal injected into a slurry cup, and FIG. 19 is a graph illustrating the results of the appearance inspection according to a change in an EMS stirring time.

Referring to FIGS. 17 to 19, it can be seen that, when the temperature of the molten metal injected into the slurry cup is 600° C. to 609° C., a failure rate is 19%, when the temperature of the molten metal injected into the slurry cup is 610° C. to 650° C., the failure rate is 11%, and when the temperature of the molten metal injected into the slurry cup is 651° C. to 670° C., the failure rate is 19%.

In addition, it can be confirmed that, when the EMS stirring time is 5 seconds to 9 seconds, a failure rate is 15%, when the EMS stirring time is 10 seconds to 30 seconds, the failure rate is 6%, and when the EMS stirring time is 31 seconds to 40 seconds, the failure rate is 11%.

Accordingly, it can be confirmed that an appearance of the semi-solid slurry is the most appropriate when the electronic stirring (EMS stirring) is performed at temperatures of 610° C. to 650° C. for 10 seconds to 30 seconds.

2. Internal Defect Inspection

Figure 20:
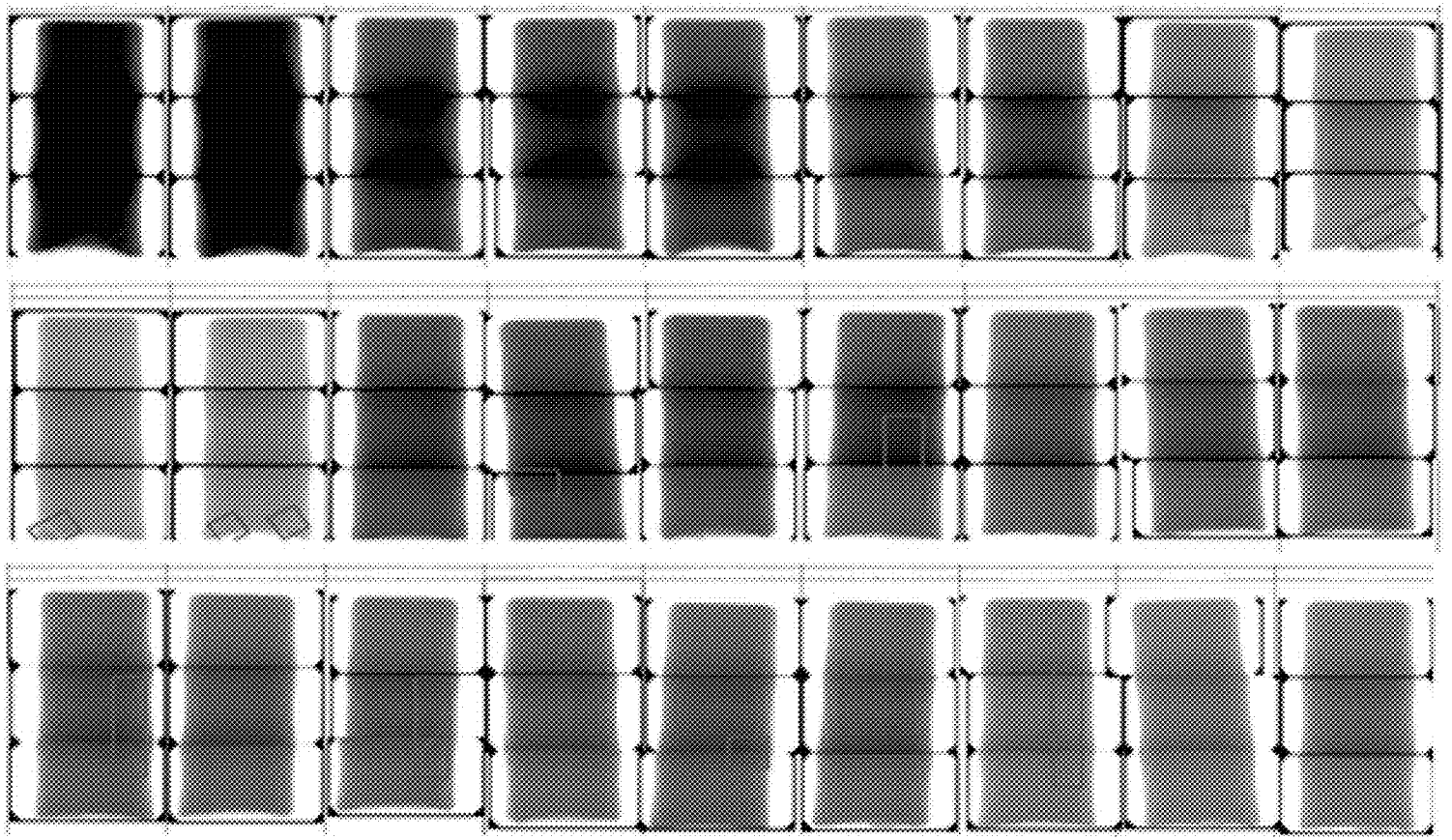
FIG. 20 is an X-ray result pictures according to each portion of a semi-solid slurry.
Figure 21:
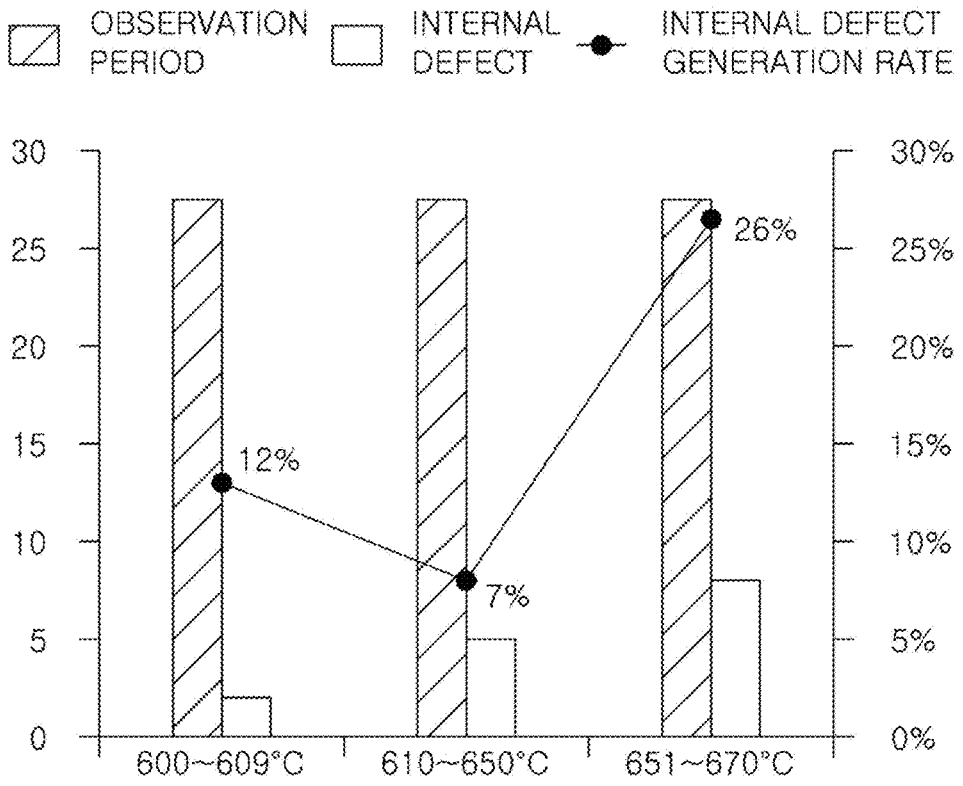
FIG. 21 is a graph illustrating results of an internal defect state according to a change in a temperature of a molten metal injected into a slurry cup.
Figure 22:
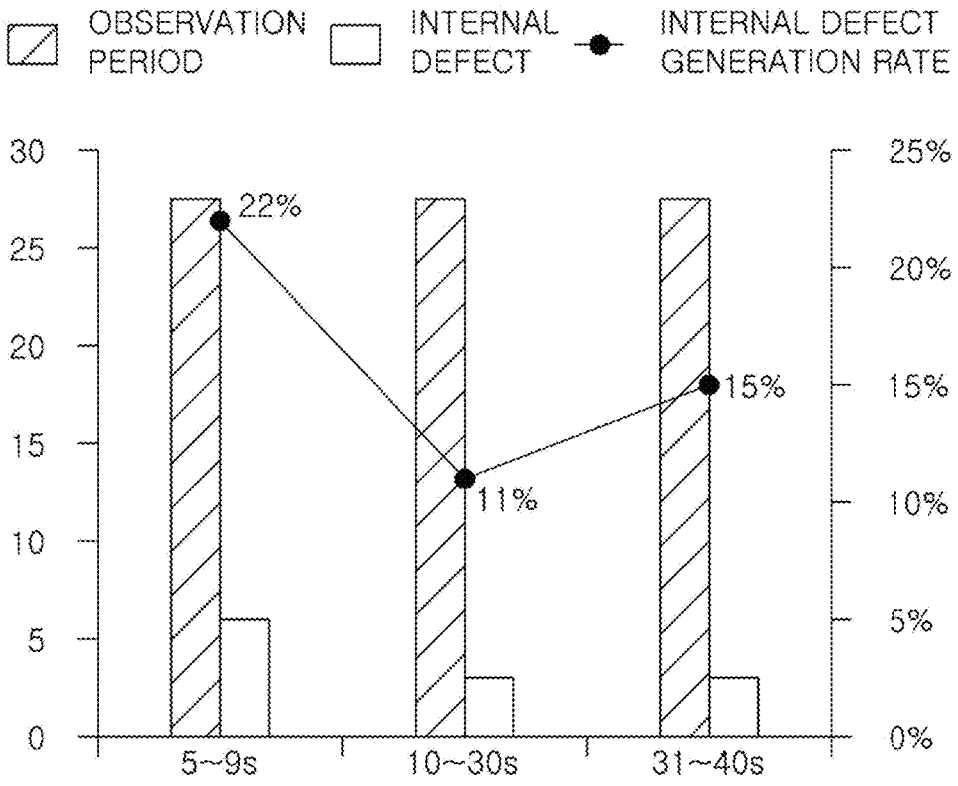
FIG. 22 is a graph illustrating results of an internal defect state according to a change in an EMS stirring time.

FIG. 20 is an X-ray result pictures according to each portion of a semi-solid slurry, FIG. 21 is a graph illustrating results of an internal defect state according to a change in a temperature of a molten metal injected into a slurry cup, and FIG. 22 is a graph illustrating results of an internal defect state according to a change in an EMS stirring time.

Referring to FIGS. 20 to 22, it can be seen that, when t the temperature of the molten metal injected into the slurry cup is 600° C. to 609° C., a defect generation rate is 12%, when t the temperature of the molten metal injected into the slurry cup is 610° C. to 650° C., the defect generation rate is 7%, and when t the temperature of the molten metal injected into the slurry cup is 651° C. to 670° C., the defect generation rate is 26%.

In addition, it can be confirmed that, when the EMS stirring time is 5 seconds to 9 seconds, a failure rate is 22%, when the EMS stirring time is 10 seconds to 30 seconds, the failure rate is 30%, and when the EMS stirring time is 31 seconds to 40 seconds, the failure rate is 15%.

Accordingly, it can be confirmed that the internal defect of the semi-solid slurry is the most appropriate when the electronic stirring (EMS stirring) is performed at temperatures of 610° C. to 650° C. for 10 seconds to 30 seconds.

3. Temperature Distribution Analysis

Figure 23:
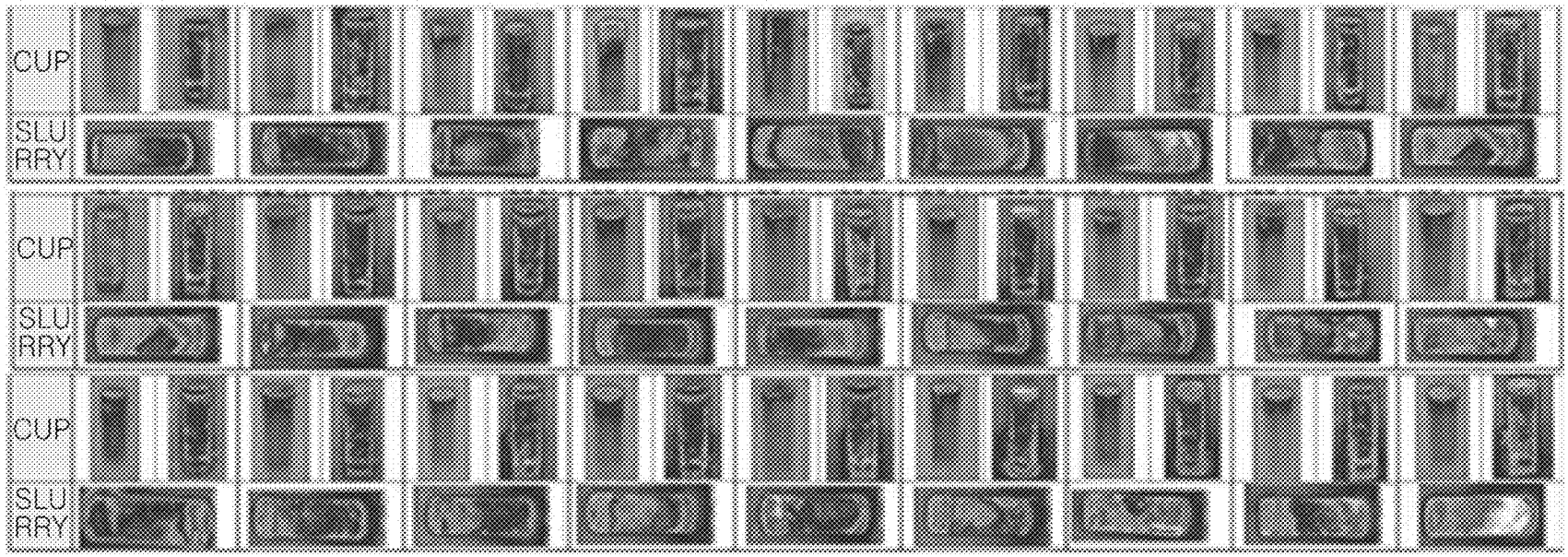
FIG. 23 illustrates pictures of results of a temperature distribution analysis according to each portion of a semi-solid slurry using a thermal imaging camera.
Figure 24:
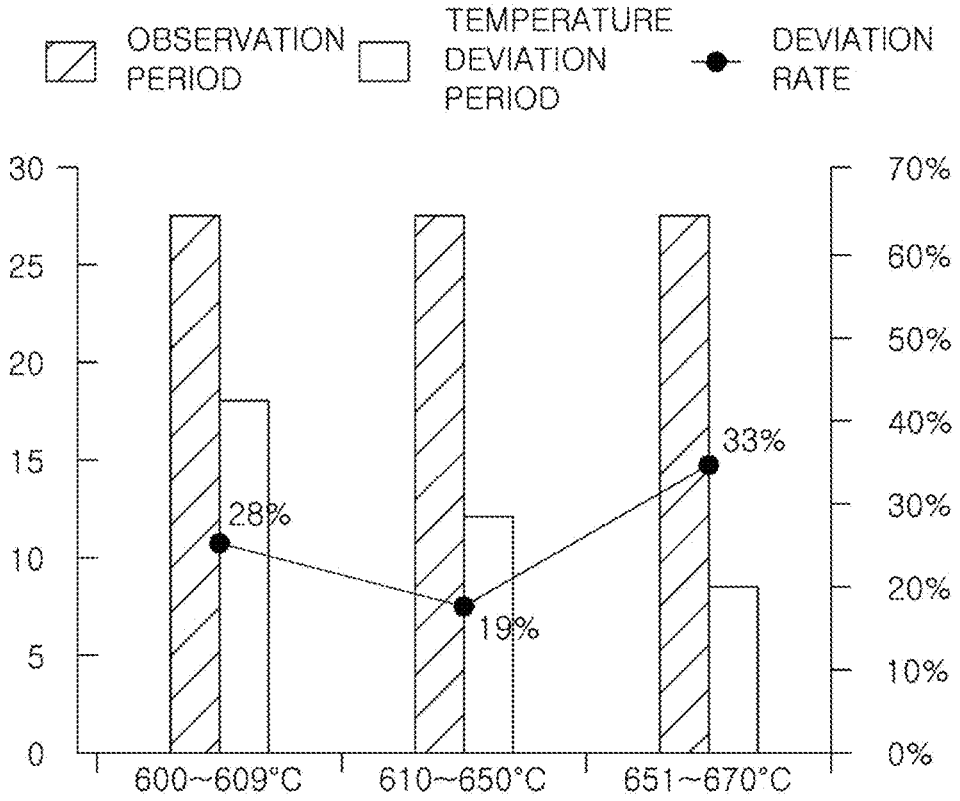
FIG. 24 is a graph of a temperature deviation rate according to a change in a temperature of a molten metal injected into a slurry cup.
Figure 25:
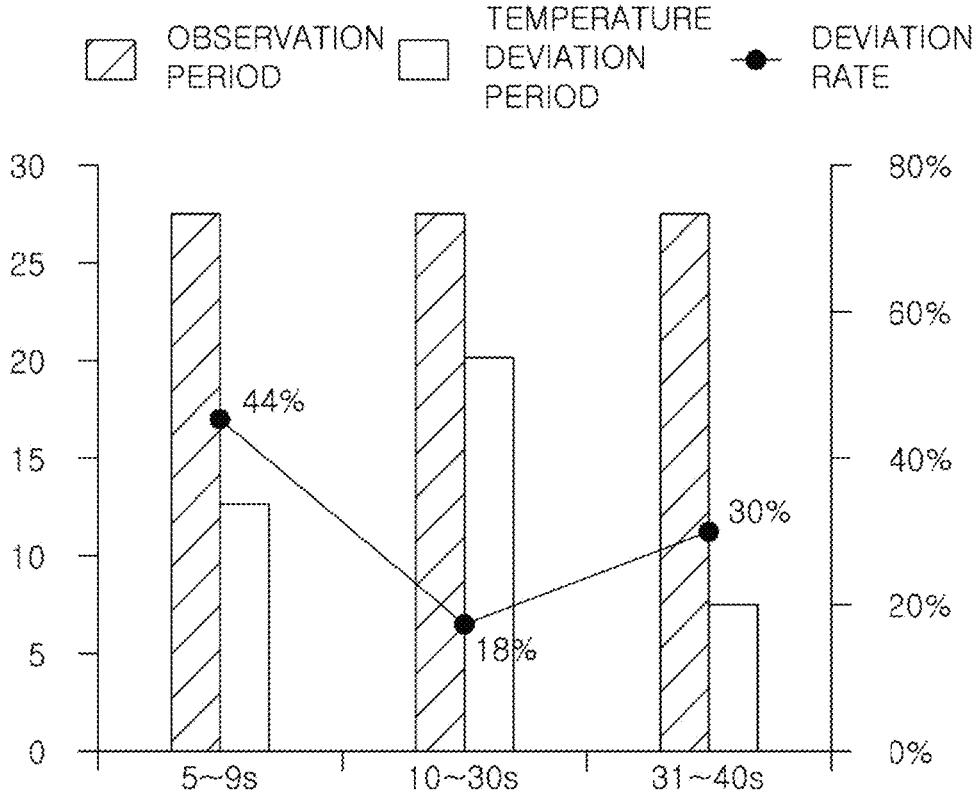
FIG. 25 is a graph of a temperature deviation rate according to a change in an EMS stirring time.

FIG. 23 illustrates pictures of results of a temperature distribution analysis according to each portion of a semi-solid slurry using a thermal imaging camera, FIG. 24 is a graph of a temperature deviation rate according to a change in a temperature of a molten metal injected into a slurry cup, and FIG. 25 is a graph of a temperature deviation rate according to a change in an EMS stirring time.

Referring to FIGS. 23 to 25, it can be seen that, when the temperature of the molten metal injected into the slurry cup is 600° C. to 609° C., a deviation rate is 28%, when the temperature of the molten metal injected into the slurry cup is 610° C. to 650° C., the deviation rate is 19%, and when the temperature of the molten metal injected into the slurry cup is 651° C. to 670° C., the deviation rate is 33%.

In addition, it can be confirmed that, when the EMS stirring time is 5 seconds to 9 seconds, a deviation rate is 44%, when the EMS stirring time is 10 seconds to 30 seconds, the deviation rate is 18%, and when the EMS stirring time is 31 seconds to 40 seconds, the deviation rate is 30%.

Accordingly, it can be confirmed that a temperature distribution for a semi-solid slurry is the most appropriate when the electronic stirring (EMS stirring) is performed at temperatures of 610° C. to 650° C. for 10 seconds to 30 seconds.

Figure 26A:
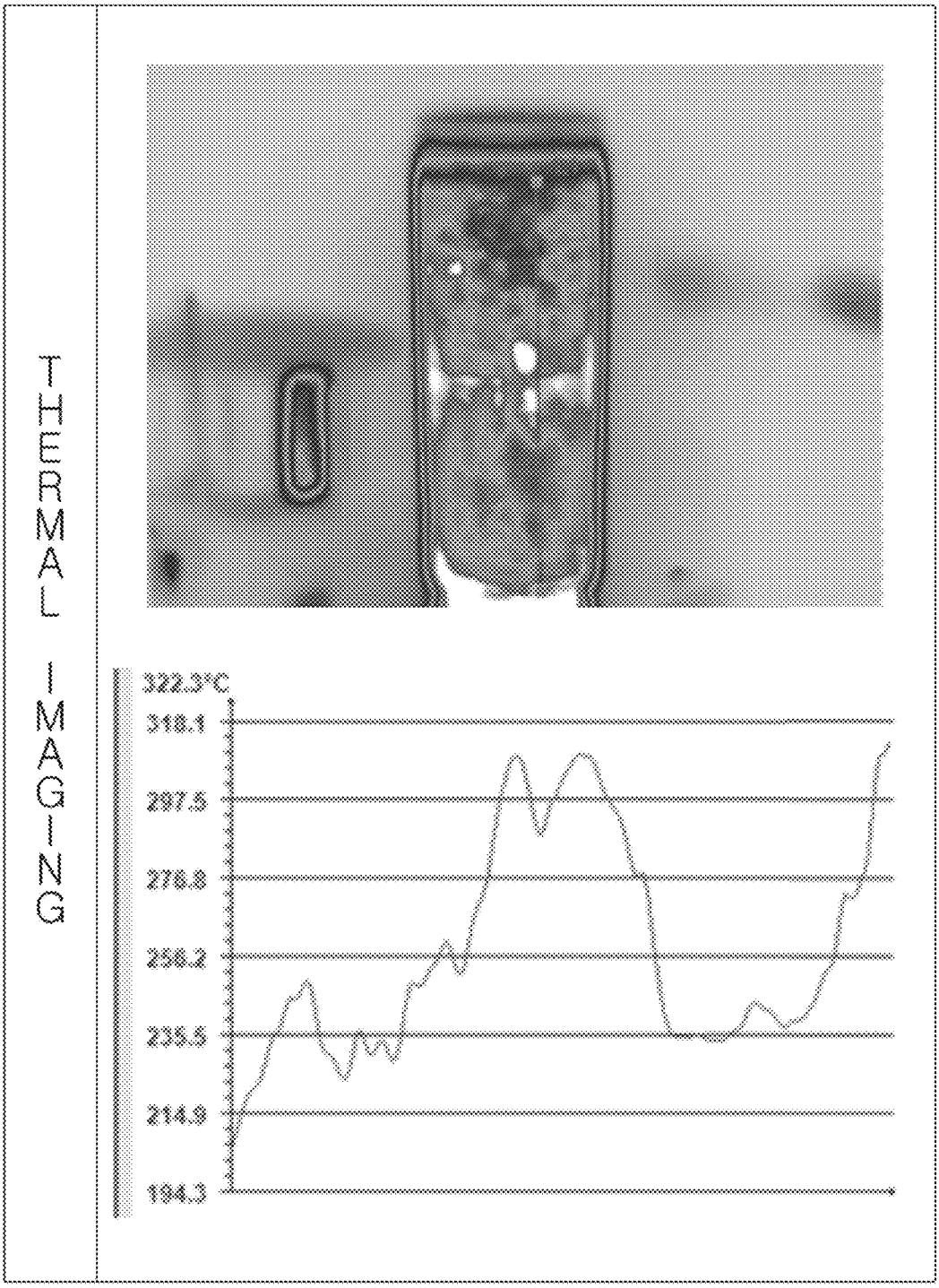
FIGS. 26A and 26B are temperature distribution analysis result pictures of the semi-solid slurry according to a slurry cup preheating temperature using the thermal imaging camera and temperature distribution graphs of the semi-solid slurry.
Figure 26B:
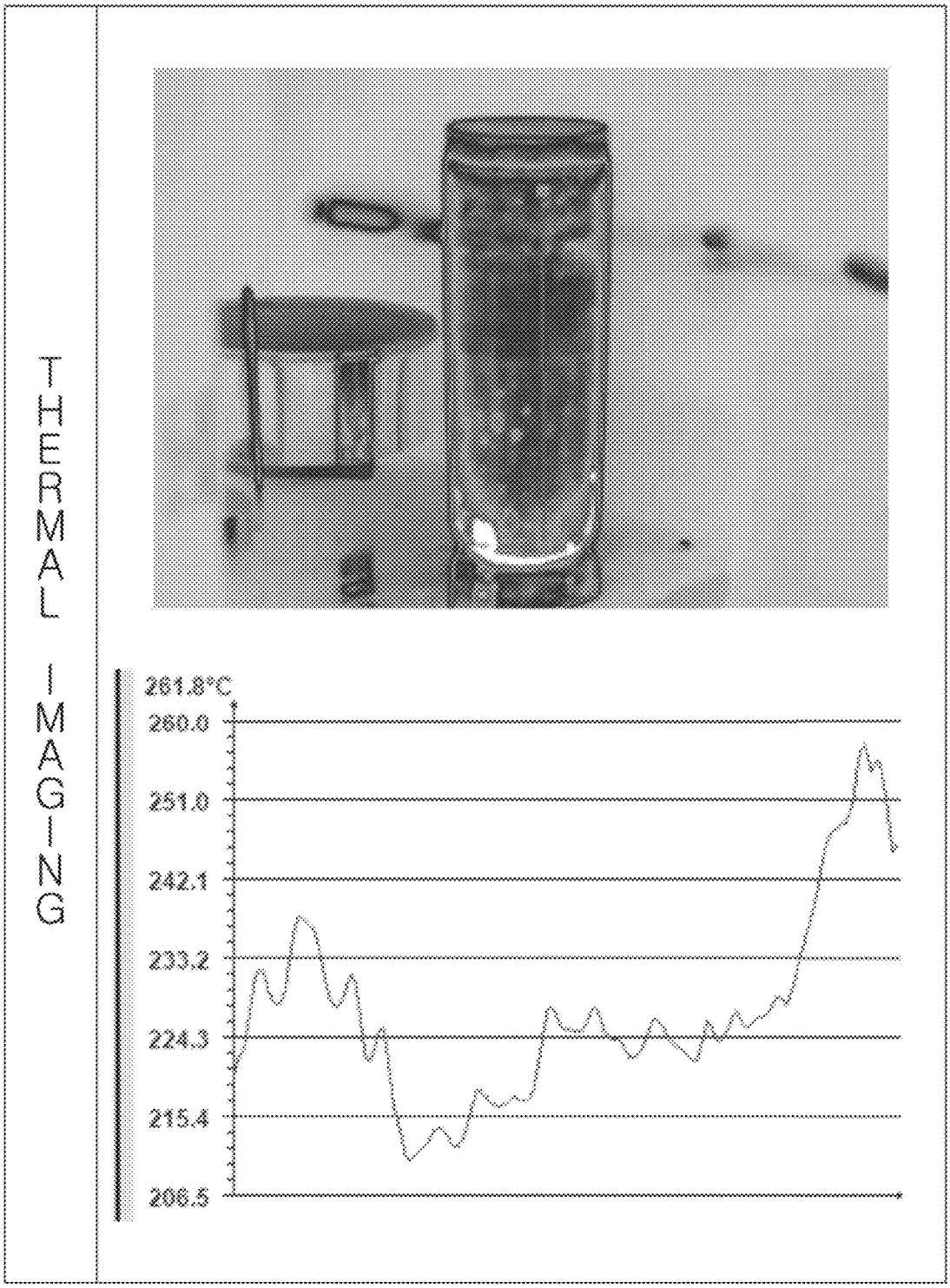

FIGS. 26A and 26B are temperature distribution analysis result pictures of a semi-solid slurry according to a slurry cup preheating temperature using a thermal imaging camera and temperature distribution graphs of the semi-solid slurry.

Referring to FIGS. 26A and 26B, it can be confirmed that, when a preheating temperature of a slurry cup is out of 60° C. to 120° C., a temperature distribution is in a central portion of the semi-solid slurry, and when the preheating temperature of the slurry cup is within 60° C. to 120° C., the temperature distribution in the central portion of the semi-solid slurry is improved.

Accordingly, it can be confirmed that the preheating temperature of the slurry cup is the most appropriate at temperatures of 60° C. to 120° C.

Figure 27A:
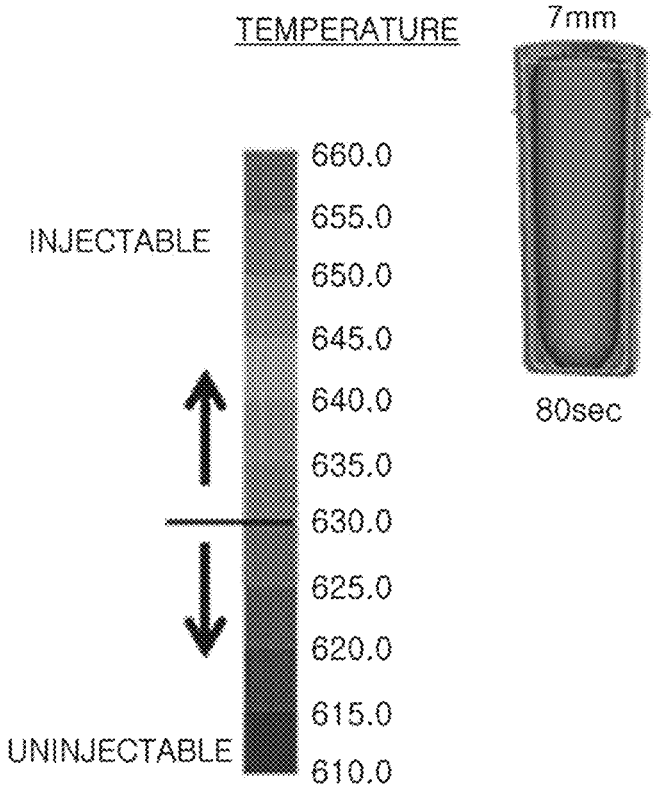
FIGS. 27A and 27B are temperature distribution analysis result pictures according to a thickness of the slurry cup using the thermal imaging camera.
Figure 27B:
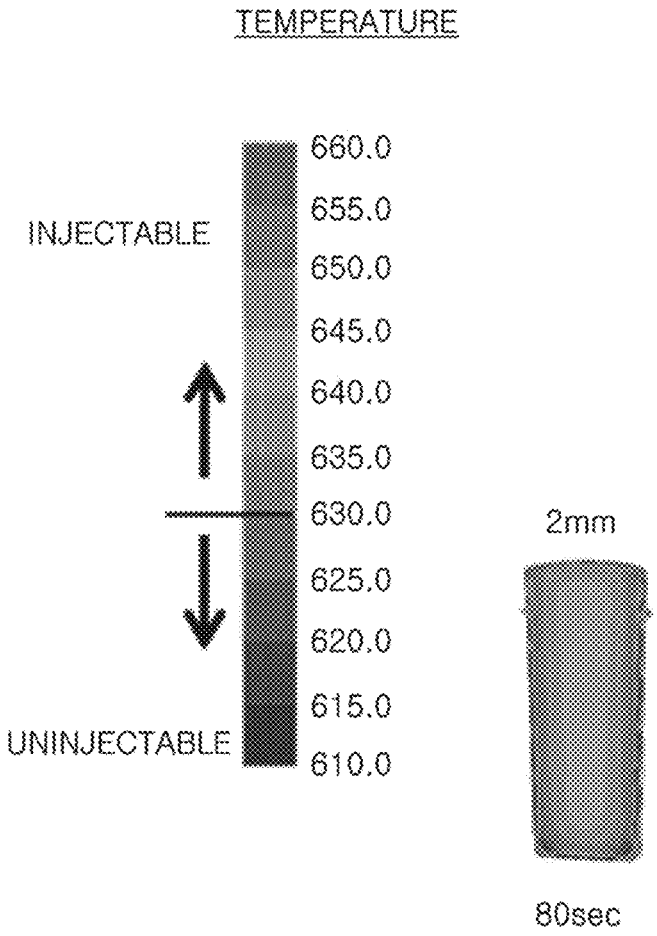

FIGS. 27A and 27B are temperature distribution analysis result pictures according to a thickness of the slurry cup using a thermal imaging camera.

Referring to FIGS. 27A and 27B, it can be confirmed that, when the thickness of the semi-solid slurry cup is 7 mm (FIG. 27A), a temperature is reduced too quickly after 80 seconds and a shell is generated, and thus, injection is not possible, and when the thickness of the semi-solid slurry cup is 2 mm (FIG. 27B), the temperature is not reduced quickly after 80 seconds and a temperature gradient on a wall is small, and thus, slurry can be appropriately molded.

In addition, although not illustrated in the drawings, it can be confirmed that an appropriate thickness of the slurry cup is 2 mm to 6 mm because temperature gradients on all walls are small up to 6 mm which results in appropriate slurry molding.

4. Microstructure Inspection

Figure 28:
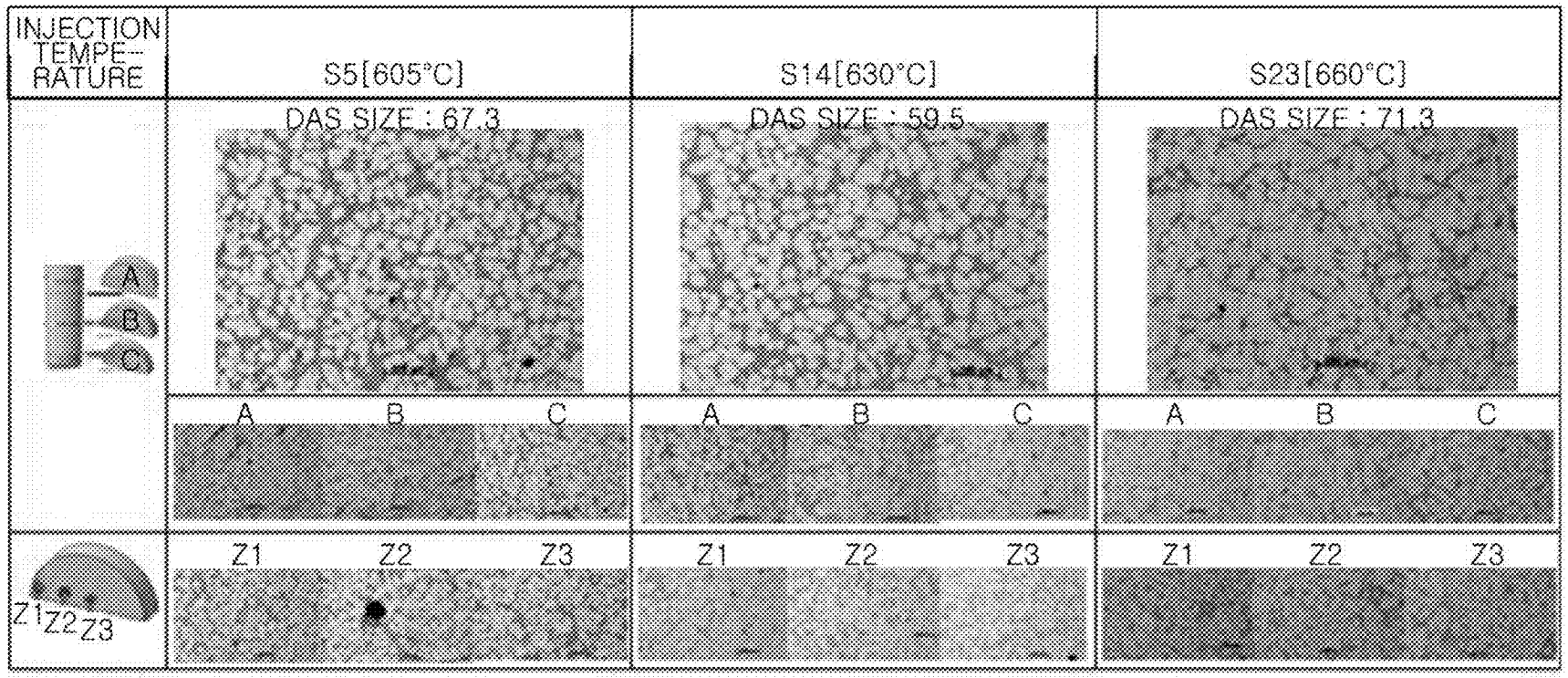
FIG. 28 illustrates microstructure analysis result pictures according to the temperature of the molten metal injected into the slurry cup.
Figure 29:
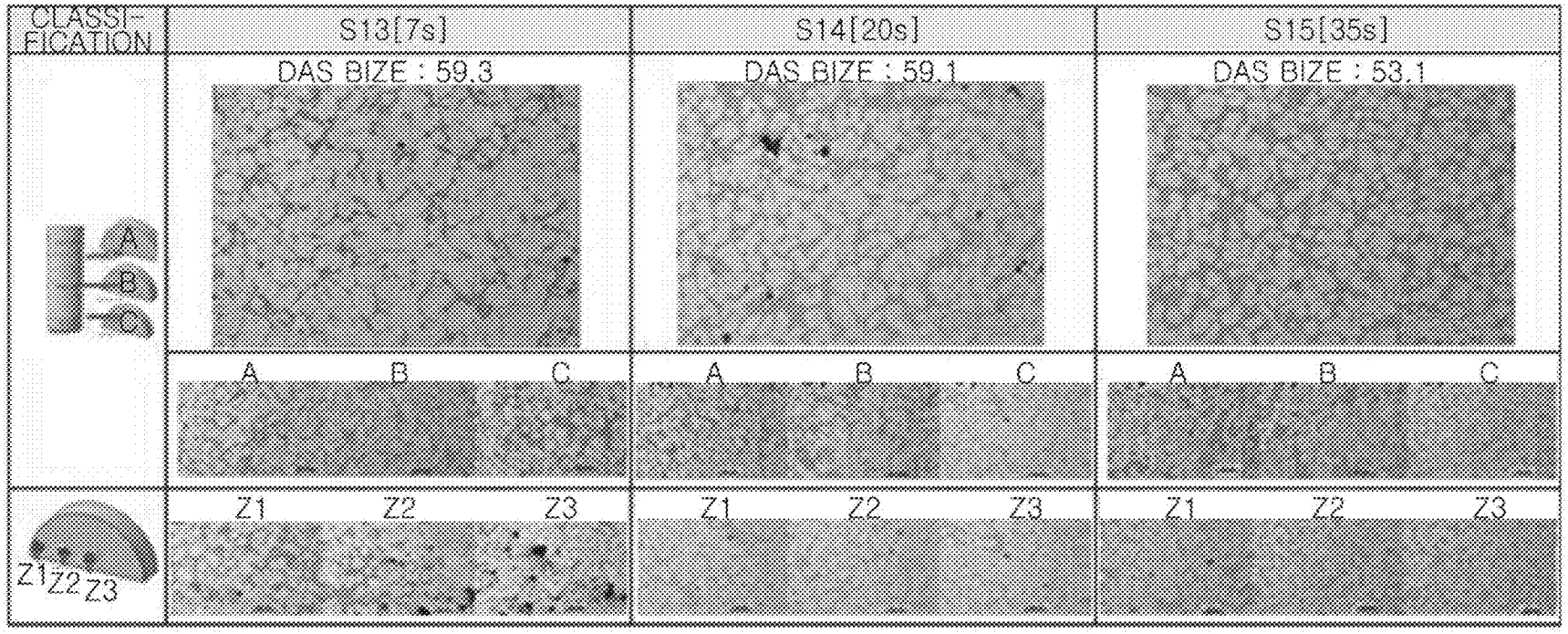
FIG. 29 illustrates microstructure analysis result pictures according to an EMS stirring time.

FIG. 28 illustrates microstructure analysis result pictures according to a temperature of a molten metal injected into a slurry cup, and FIG. 29 illustrates microstructure analysis result pictures according to an EMS stirring time. In addition, Table 1 is a summary table of microstructure analysis results according to the temperature of the molten metal injected into the slurry cup, and Table 2 is a summary table of microstructure analysis results according to the EMS stirring time.

TABLE 1

| Classification | 605° C. | 630° C. | 660° C. |
|---|---|---|---|
| Structure size | Good | Good | Bad |
| Spheroidization and uniformity | Good | Good | Bad |
| Bubble generation rate | Bad | Good | Good |
| Summary | Structure is uniform, but there are many air bubbles in slurry | Structure spheroidization is well performed, and ultra-uniformity is excellent | Structure is not uniform and dendritically exists |

TABLE 2

| Classification | 7 seconds | 20 seconds | 35 seconds |
|---|---|---|---|
| Structure size | Good | Good | Good |
| Spheroidization and uniformity | Bad | Good | Good |
| Bubble generation rate | Bad | Good | Good |
| Summary | Severe structure imbalance (dendritic existence) | Structure is uniform | Structure is uniform |

Referring to FIGS. 28 and 29 and Tables 1 and 2, it can be confirmed that, when the temperature of the molten metal injected into the slurry cup is 605° C., a structure is uniform, but a large amount of air bubbles are present in the slurry, and when the temperature of the molten metal injected into the slurry cup is 630° C., structure spheroidization is well done and ultra-uniformity is excellent, and when the temperature of the molten metal injected into the slurry cup is 660° C., the structure is not uniform and exists dendritically. In addition, when an EMS stirring time is less than or equal to 7 seconds, there are severe structure imbalances, and when the EMS stirring time is 20 seconds and 35 seconds, all structures are uniform. However, because there is no difference between 35 seconds and 20 seconds, it is determined that only time and cost increase, and thus, it is determined to be inappropriate.

The results are similar in a range to which the limited conditions belong, that is, a range of injection temperature conditions other than 600° C. to 609° C., 610° C. to 650° C., and 651° C. to 670° C. and in the EMS stirring times of 5 seconds to 9 seconds, 10 seconds to 30 seconds, and 31 seconds to 40 seconds, in addition to the limited conditions.

Accordingly, it can be confirmed that a microstructure result of the semi-solid slurry is the most appropriate when the electronic stirring (EMS stirring) is performed at temperatures of 610° C. to 650° C. for 10 seconds to 30 seconds.

When reviewing the results of the above-described experimental examples, it can be confirmed that a semi-solid slurry has the best quality when electronic stirring (EMS stirring) is performed at temperatures of 610° C. to 650° C. for 10 seconds to 30 seconds.

Experimental Example 2

Observation of Microstructure Change for Each Manufacturing Condition According to Improvement Processing In order to examine results of a semi-solid slurry according to addition of a molten metal of the improved additive (a mixture of aluminum, titanium, and boron) according to an embodiment of the present invention, aluminum (Al) of 4 wt % to 6 wt %, titanium (Ti) 0.5 wt % to 1.5 wt %, and boron (B) of 0.005% to 0.015% were added to a molten metal of 100 wt %, and then, results of a slurry structure were observed. The results are illustrated in FIG. 30.

Figure 30:
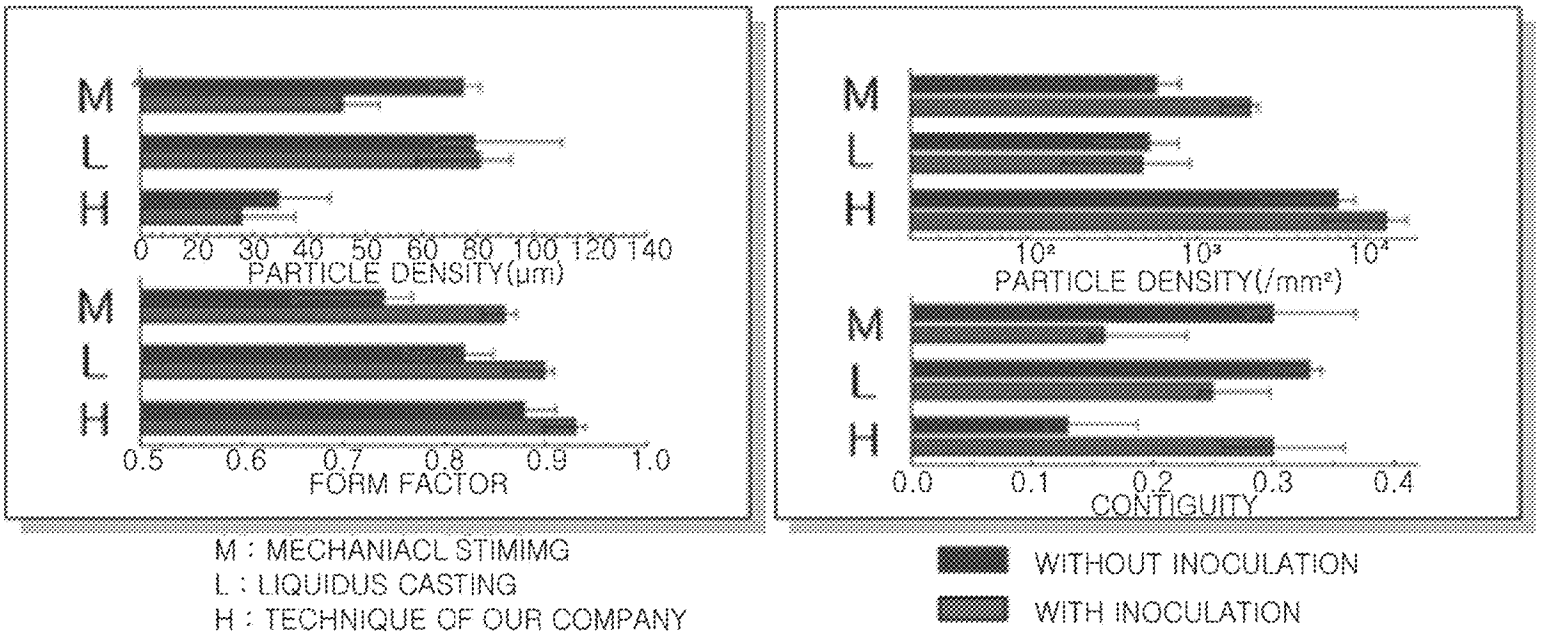
FIG. 30 illustrates graphs illustrating a change in property of a semi-solid slurry structure according to processing of an improved additive.

FIG. 30 illustrates graphs illustrating a change in property of a semi-solid slurry structure according to processing of an improved additive.

Referring to FIG. 30, it can be confirmed that, when the semi-solid slurry was manufactured after an improved additive (an improved processing agent is described in the graph) of aluminum (Al) of 4 wt % to 6 wt %, titanium (Ti) 0.5 wt % to 1.5 wt %, and boron (B) of 0.005% to 0.015% was added to the molten metal of 100 wt %, a particle size was reduced compared to an additive without the improved additive, and a particle density, spheroidization, and contiguity were increased, and a metal structure advantageous for a mechanical property was found.

Although the embodiments of the present invention are described above with reference to the accompanying drawings, it will be understood that the present invention can be implemented in other specific forms by those skilled in the art. Accordingly, the embodiments described above are illustrative in all respects and not restrictive.

The invention claimed is:

1. A semi-solid slurry manufacturing apparatus using a slurry cup, the apparatus comprising:

a high-pressure washing unit configured to simultaneously remove and cool a foreign substance in the slurry cup by using high-pressure air blow;

a release agent coating unit configured to apply a release agent to an inside of the slurry cup in which the foreign substance is removed and cooled by the high-pressure washing unit;

a preheating unit configured to preheat the slurry cup to which the release agent is applied by the release agent coating unit;

an injection unit configured to inject a molten metal into the slurry cup preheated by the preheating unit;

an electronic stirring unit configured to electronically stir the slurry cup into which the molten metal is injected by the injection unit; slurry cup fixing means configured to hold or insert the slurry cup; a plunger disposed at a lower portion of the slurry cup fixing means and connected to a drive unit by a piston rod and configured to raise or lower the slurry cup held by or inserted into the slurry cup fixing means, wherein the slurry cup fixing means and the plunger are disposed in at least one of the high-pressure washing unit, the release agent coating unit, the preheating unit, the injection unit, and the electronic stirring unit; and an angle rotation adjustment portion disposed at the lower portion of the slurry cup fixing means and configured to rotate the slurry cup after an angle of the slurry cup is adjusted.

2. The semi-solid slurry manufacturing apparatus of claim 1, wherein the angle rotation adjustment portion comprises:

two rotation plate bodies connected to each other by a connection unit, wherein the two rotation plate bodies are symmetrical to each other and each of the rotation plate body includes a plurality of movement grooves; and an angle adjustment ball disposed in a center between the two rotation plate bodies and configured to move along one of the plurality of movement grooves by a magnetic field applied by a magnetic field control unit, and wherein the connection unit is configured to fluidly vary a height thereof.

3. The semi-solid slurry manufacturing apparatus of claim 1, wherein the angle rotation adjustment portion comprises:

a donut-shaped guide plate body including one side having a low inclination portion and an other side having a high inclination portion; and a rotation body provided at a center of the donut-shaped guide plate body and configured to rotate the slurry cup.

4. The semi-solid slurry manufacturing apparatus of claim 1, further comprising:

a slurry cup thickness determining unit configured to determine a thickness of the slurry cup before the foreign substance in the slurry cup is removed and cooled, wherein the slurry cup thickness determining unit determines the thickness of the slurry cup by layering a plurality of thin slurry cup faceted bodies.

5. The semi-solid slurry manufacturing apparatus of claim 1, wherein the electronic stirring unit sets or adjusts process parameters including a voltage, a current, and a stirring time by using a control unit that performs an automatic control according to the process parameters.

6. A component molding system including a semi-solid slurry manufacturing apparatus, the system comprising:

the semi-solid slurry manufacturing apparatus according to claim 1;

a separation unit configured to separate from the slurry cup a semi-solid slurry manufactured by transferring the slurry cup of the semi-solid slurry manufacturing apparatus; and a molding unit configured to receive the manufactured semi-solid slurry from the separation unit and to mold a component.

* * * * *